United States Patent [19]

Ishikawa et al.

[11] Patent Number: 4,968,588

[45] Date of Patent: Nov. 6, 1990

[54] METHOD FOR PROCESSING SILVER HALIDE COLOR PHOTOGRAPHIC MATERIALS WITH A COLOR DEVELOPER COMPRISING NO BENZYL ALCOHOL AND AN ACCELERATOR

[75] Inventors: Takatoshi Ishikawa; Morio Yagihara, both of Kanagawa, Japan

[73] Assignee: Fuji Photo Film Co., Ltd., Kanagawa, Japan

[21] Appl. No.: 404,480

[22] Filed: Sep. 8, 1989

Related U.S. Application Data

[63] Continuation of Ser. No. 8,436, Jan. 29, 1987, abandoned.

[30] Foreign Application Priority Data

Jan. 30, 1986 [JP] Japan ..... 61-19109
May 19, 1986 [JP] Japan ..... 61-114277

[51] Int. Cl.[5] ..... G03C 5/24; G03C 7/30

[52] U.S. Cl. ..... 430/464; 430/434; 430/467; 430/469; 430/435; 430/558

[58] Field of Search ..... 430/380, 434, 464, 467, 430/469, 435, 553

[56] References Cited

U.S. PATENT DOCUMENTS

| | | | |
|---|---|---|---|
| 3,960,569 | 6/1976 | Ono | 430/469 |
| 3,984,293 | 10/1976 | Shimamura et al. | 430/268 |
| 3,996,054 | 12/1976 | Santemma et al. | 430/377 |
| 4,267,263 | 5/1981 | Kunitz et al. | 430/469 |
| 4,269,929 | 5/1981 | Nothnagle | 430/264 |
| 4,618,573 | 10/1986 | Okamura et al. | 430/558 |
| 4,639,413 | 1/1987 | Kawagishi et al. | 430/546 |

FOREIGN PATENT DOCUMENTS

| | | | |
|---|---|---|---|
| 158446 | 8/1985 | Japan | 430/467 |

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A method for processing a silver halide color photographic material is described, which comprises processing a silver halide color photographic material comprising a reflective support having thereon at least one silver halide emulsion layer for a period of 2 minutes and 30 seconds or less with a color devleoping solution which does not substantially contain benzyl alcohol and which contains at least one of compounds selected from the group consisting of a compound represented by formula (I), a compound represented by formula (II), hydantoic acid, allylamine, aminoguanidine, o-aminobenzoic acid, L-(+)-cysteine, benzylamine, DL-serine, morpholine, N-hydroxyethyl morpholine, o-aminobenzyl alcohol, quinuclidine, or salts thereof, tetramethylammonium acetate, choline, or choline chloride, (I)

wherein $R^1$ represents a hydroxyalkyl group having from 2 to 10 carbon atoms; and $R^2$ and $R^3$ each represents a hydrogen atom, an alkyl group having from 1 to 10 carbon atoms, a hydroxyalkyl group having from 2 to 20 carbon atoms or a group represented by the formula wherein n represents an integer from 1 to 10; and X and Y each represents a hydrogen atom, an alkyl group having from 1 to 10 carbon atoms, or a hydroxyalkyl group having from 2 to 10 carbon atoms.

(II)

wherein $R^4$ represents an alkyl group having from 1 to 10 carbon atoms; $R^5$ and $R^6$ each represents a hydrogen atom or an alkyl group having from 1 to 10 carbon atoms.

In accordance with this method for processing a silver halide color photographic material, color images having high coloring property can be obtained within a short period of a color developing time without substantially using benzyl alcohol, which is disadvantageous in view of environmental pollution, in the color developing solution.

The effect of the present invention is particularly remarkable in the case wherein the silver halide color photographic material contains a pyrazoloazole type magenta coupler represented by formula (III) as described in the specification.

21 Claims, No Drawings

METHOD FOR PROCESSING SILVER HALIDE COLOR PHOTOGRAPHIC MATERIALS WITH A COLOR DEVELOPER COMPRISING NO BENZYL ALCOHOL AND AN ACCELERATOR

This is a continuation of application No. 07/008,436, filed Jan. 29, 1987 now abandoned.

FIELD OF THE INVENTION

This invention relates to a process for processing silver halide color photographic materials and, more particularly, the invention relates to a processing process for color photographic materials including a very shortened color development time without using benzyl alcohol.

BACKGROUND OF THE INVENTION

Hitherto, various kinds of developing agent penetrants have been investigated for increasing the coloring property of color photographic light-sensitive materials and, in particular, a process of quickening color development by adding benzyl alcohol to a color developer has been widely used at present for the processing of color photographic materials because of accelerating a coloring effect, particularly color photographic papers.

However, in the case of using benzyl alcohol, diethylene glycol, triethylene glycol, etc., must be used as the solvent therefor due to the low water solubility thereof. Since, however, the above-described compounds including benzyl alcohol have high BOD (biochemical oxygen demand) and COD (chemical oxygen demand) pollution loading values, it is preferred to avoid use of benzyl alcohol as much as possible.

Furthermore, even in the case of using the aforesaid solvent, it requires a long time to dissolve benzyl alcohol, and hence it is also better to avoid use of benzyl alcohol for the purpose of reducing the work load involved in preparing the solution of benzyl alcohol.

Also, when benzyl alcohol existing in a color developer is carried in a bleach bath or a blix (bleach-fix) bath which is a post-bath of the color developer, it causes the formation of the leuco dye of a cyan dye, which further causes the reduction of coloring density. Still further, when such benzyl alcohol exists in a bleaching solution or a blix solution, it delays the washing out speed of developer components from color photographic materials, and hence it sometimes results in adverse influences on the stability or storability of color images of processed color photographic materials. Accordingly, it is also preferred to avoid use of benzyl alcohol for these reasons also.

Color development is generally performed for about 3 to 4 minutes, but recently with the shortening of the time for delivering finished photographic products and the reduction of laboratory work, it has been desired to shorten the processing time for photographic materials.

On the other hand, when the development time for color photographic materials is shortened without using benzyl alcohol, which is a coloring accelerator, the coloring density is inevitably greatly reduced.

For solving the above-described problems, various color development accelerators have been described, for example, in U.S. Pat. Nos. 2,950,970, 2,515,147, 2,496,903, 2,304,925, 4,038,075, 4,119,462, British Patents Nos. 1,430,998, 1,455,413, Japanese Patent Application (OPI) Nos. 15831/78, 62450/80, 62451/80, 62452/80, 62453/80, 50536/83 and 162256/85 (the term "OPI" as used herein refers to a "published unexamined Japanese patent application"), Japanese Patent Publication Nos. 12422/76, 49728/80, etc. However, even by the use of these color development accelerators, a satisfactory coloring density has not yet been obtained.

Also, methods for incorporating color developing agents in color photographic materials are proposed as described, for example, in U.S. Pat. Nos. 3,719,492, 3,342,559, 3,342,597, Japanese Patent Application (OPI) Nos. 6235/81, 16133/81, 97531/82, 83565/82, etc., but these methods have disadvantages in that the color development is delayed and the formation of fog is increased, and thus are not proper methods.

Furthermore, a method of using a silver chloride emulsion as described, for example, in Japanese Patent Application (OPI) Nos. 95345/83, 232342/84, 19140/85, etc., may shorten the color development time but is not a proper method since the formation of fog is increased.

As described above, a method of obtaining color images having satisfactory quality in a shortened time using a color developer containing substantially no benzyl alcohol has not yet been found.

On the other hand, techniques of adding a compound represented by formula (I) shown hereinafter to a developing solution are disclosed in Japanese Patent Application (OPI) Nos. 106244/81 and 3532/79, etc. However, the former relates to the technique for obtaining high contrast by black-and-white development for lithography using the compound together with a 3-pyrazolidone in a black-and-white developing solution. The latter relates to the technique for increasing stability of a color developing solution by means of the addition of alkanolamines thereto. There is not disclosure regarding accelerating effect on color development at all. Therefore, benzyl alcohol could not be eliminated from the color developing solution used in color development processing in a short period of time as described in the present invention. Accordingly, when the proposals described above are employed under the condition of shortening a color development time using a color developer substantially free from benzyl alcohol, the coloring property of, in particular, magenta dye, is reduced, and a satisfactory result has not been obtained.

Further, the compound represented by formula (I) causes the formation of severe fog when used in conventional color developing solutions. However, it exhibits the excellent development accelerating effect in the case wherein benzyl alcohol is not present in the color developing solution and the developing time is short as the present invention.

SUMMARY OF THE INVENTION

Therefore, an object of the present invention is to provide a method for processing a silver halide color photographic material which can provide sufficiently high coloring property using a color developing solution containing substantially no benzyl alcohol in a short period of processing time, particularly a color developing time of 2 minutes and 30 seconds or less.

Other objects of the present invention will become apparent from the following description and examples.

These objects of the present invention can be attained by employing a method for processing a silver halide color photographic material which comprises processing a silver halide color photographic material comprising a reflective support having thereon at least one silver halide emulsion layer for a period of 2 minutes and 30 seconds or less with a color developing solution which does not substantially contain benzyl alcohol and which contains at least one of compounds selected from the group consisting of a compound represented by formula (I), a compound represented by formula (II), hydantoic acid, allylamine, aminoguanidine, o-aminobenzoic acid, L-(+)-cysteine, benzylamine, DL-serine, morpholine, N-hydroxyethyl morpholine, o-aminobenzyl alcohol, quinuclidine, or salts thereof, tetramethylammonium acetate, choline, or choline chloride.

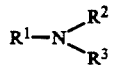

(I)

wherein $R^1$ represents a hydroxyalkyl group having from 2 to 10 carbon atoms; and $R^2$ and $R^3$ (which may be the same or different) each represents a hydrogen atom, an alkyl group having from 1 to 10 carbon atoms, a hydroxyalkyl group having from 2 to 20 carbon atoms, or a group represented by the formula

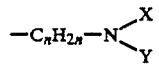

wherein n represents an integer from 1 to 10; and X and Y (which may be the same or different) each represents a hydrogen atom, an alkyl group having from 1 to 10 carbon atoms, or a hydroxyalkyl group having from 2 to 10 carbon atoms.

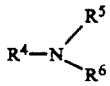

(II)

wherein $R^4$ represents an alkyl group having from 1 to 10 carbon atoms; $R^5$ and $R^6$ each represents a hydrogen atom or an alkyl group having from 1 to 10 carbon atoms.

DETAILED DESCRIPTION OF THE INVENTION

The effect of the present invention is particularly remarkable when the silver halide color photographic material contains a magenta coupler represented by formula (III)

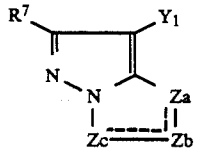

(III)

wherein $R^7$ represents a hydrogen atom or a substituent; $Y_1$ represents a group capable of being released upon a coupling reaction with an oxidation product of an aromatic primary amine developing agent; Za, Zb and Zc each represents an unsubstituted methine group, a substituted methine group, =N— or —NH—, one of the Za-Zb bond and the Zb-Zc bond being a double bond and the other being a single bond; when the Zb-Zc bond is a carbon-carbon double bond, the Zb=Zc bond forms a part of a condensed aromatic ring; or $R^4$ or $Y_1$ forms a dimer or a higher polymer; or when Za, Zb or Zc is a substituted methine group, the substituted methine group forms a dimer or a higher polymer.

The compounds represented by formula (I) are described in more detail below.

In formula (I), the hydroxyalkyl group represented by $R^1$ preferably has from 2 to 5 carbon atoms.

In formula (I), preferably one of $R^2$ and $R^3$ is a hydroxyalkyl group having from 2 to 5 carbon atoms and the other is an alkyl group having from 2 to 5 carbon atoms. Further, one of X and Y is preferably a hydroxyalkyl group having from 2 to 5 carbon atoms and the other is an alkyl group having from 2 to 5 carbon atoms.

The compounds represented by formula (II) are described in more detail below.

In formula (II), $R^4$ preferably represents an alkyl group having from 2 to 5 carbon atoms. $R^5$ and $R^6$ each preferably represents a hydrogen atom or an alkyl group having from 1 to 5 carbon atoms.

Specific examples of the alkyl group represented by $R^2$, $R^3$, $R^4$, $R^5$, $R^6$, X or Y in formulae (I) and (II) include a methyl group, an ethyl group, an isopropyl group, an n-hexyl group, a cyclohexyl group, a decyl group, etc. . The alkyl group may be substituted with a chlorine atom, a carboxyl group, an alkoxy group, etc.

Specific examples of the hydroxyalkyl group represented by $R^1$, $R^2$, $R^3$, X or Y include a 2-hydroxyethyl group, a 2-hydroxypropyl group, a 4-hydroxybutyl group, a 2,3-dihydroxypropyl group, a 4-hydroxycyclohexyl group, a 10-hydroxydecyl group, etc. Further, the hydroxyalkyl group may have a substituent as defined for the above-described alkyl group.

A compound represented by formula (I), a compound represented by formula (II), hydantoic acid, allylamine, aminoguanidine, o-aminobenzoic acid, L-(+)cysteine, benzylamine, DL-serine, morpholine, N-hydroxyethyl morpholine, o-aminobenzyl alcohol, or quinuclidine may be used in the form of a salt thereof with an inorganic acid (for example, hydrochloric acid, sulfuric acid, etc.) or an organic acid (for example, oxalic acid, acetic acid, p-toluenesulfonic acid, etc.).

Specific examples of compounds added in the color developer which can be used in the present invention are set forth below, but the present invention should not be construed as being limited thereto.

(1) 2-(2-Aminoethylamino)ethanol
(2) Tetramethylammonium acetate
(3) Choline
(4) Choline chloride
(5) (N-Ethyl)dipropanolamine
(6) Triethanolamine
(7) Diethanolamine
(8) Ethanolamine
(9) Trimethylamine
(10) 2-Diethylamino-1-ethanol
(11) 2-Methylamino-1-ethanol
(12) 3-Dimethylamino-1,2-propanediol
(13) 3-Diethylamino-1-propanol
(14) 5-Amino-1-pentanol
(15) Diethylamine
(16) Methylamine
(17) Triethylamine
(18) Dipropylamine
(19) Diisopropylamine
(20) 3-Dimethylamino-1-propanol
(21) Hydantoic acid
(22) Allylamine
(23) Ethylamine
(24) Dimethylamine

(25) 2-Dimethylaminoethanol
(26) 2-Ethylaminoethanol
(27) Dimethylaminodecane-N-ammonium bromide
(28) (N-n-Propyl)dipropanolamine
(29) Aminoguanidine sulfate
(30) 6-Aminohexanoic acid
(31) 3-Amino-1-propanol
(32) 1-Dimethylamino-2-propanol
(33) Tripropanolamine
(34) Glycine
(35) o-Aminobenzoic acid
(36) L-(+)-Cysteine hydrochloride
(37) Benzylamine
(38) 2-Amino-1-ethanol
(39) 4-Amino-1-butanol
(40) 6-Amino-1-hexanol
(41) 1,1-Aminoundecanoic acid
(42) DL-Serine
(43) Morpholine
(44) o-Aminobenzyl alcohol
(45) Quinuclidine
(46) 1-Diethylamino-2,3-dihydroxypropane
(47) (N-n-Butyl)diethanolamine
(48) N-Methylaminoethanol
(49) (N-Hydroxyethyl)morpholine
(50) (N-n-Propyl)diethanolamine Of the above-described compounds, (5) to (8), (12), (18), (28), (33), (34), (40), (42), (43), (47), and (50) are preferred. Further, (5) to (8), (34), and (42) are more preferred. And the most preferred compound is (6).

The compounds described above are readily available as commercial products.

The amount of the compound added to a color developing solution is in a range generally from 0.01 g to 20 g, preferably from 0.1 g to 10 g, and most preferably from 0.1 g to 5 g, per liter of the color developing solution.

The magenta couplers represented by formula (III) are now described in more detail below.

In formula (III), $R^7$ represents a hydrogen atom or a substituent; $Y_1$ represents a hydrogen atom or a group capable of being released upon a coupling reaction with an oxidation product of an aromatic primary amine developing agent; Za, Zb and Zc each represents an unsubstituted methine group, a substituted methine group, =N— or —NH—, one of the Za-Zb bond and the Zb-Zc bond being a double bond and the other being a single bond; when the Zb-Zc bond is a carbon-carbon double bond, the Zb=Zc bond forms a part of a condensed aromatic ring; or $R^7$ or $Y_1$ may also form a dimer or higher polymer; or when Za, Zb or Zc is a substituted methine group, the substituted methine group forms a dimer or higher polymer.

The term "polymer" as used in the definition for formula (III) means a compound containing at least two groups represented by formula (III) in its molecule, and includes a bis coupler and a polymer coupler. The term "polymer coupler" as herein used includes a homopolymer composed of only a monomer having a moiety represented by formula (III), and preferably having a vinyl group (the monomer having a vinyl group will hereinafter be referred to as a vinyl monomer), and a copolymer composed of a vinyl monomer described above and a non-color-forming ethylenically unsaturated monomer which does not undergo coupling with the oxidation product of an aromatic primary amine developing agent.

The compounds represented by formula (III) are nitrogen-containing heterocyclic 5-membered ring-condensed 5-membered ring type couplers. Their color forming nuclei show aromaticity isoelectronic to naphthalene and have chemical structures inclusively referred to azapentalenes. The preferred compounds among the couplers represented by formula (III) include 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles, 1H-pyrazolo[1,5-d]tetrazoles and 1H-pyrazolo[1,5-a]benzimidazoles represented by formulae (IV), (V), (VI), (VII), (VIII) and (IX) described below, respectively. Of these, the compounds represented by formulae(VI) and (VII) are particularly preferred.

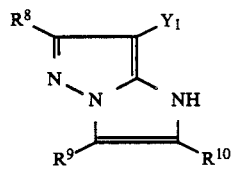
(IV)

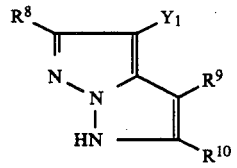
(V)

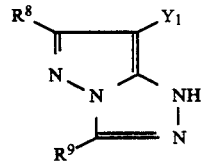
(VI)

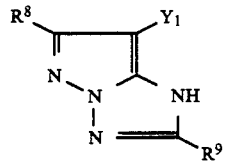
(VII)

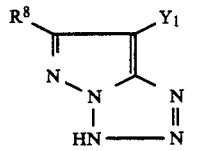
(VIII)

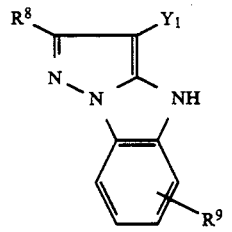
(IX)

In formulae (IV), (V), (VI), (VII), (VIII) and (IX), $R^8$, $R^9$ and $R^{10}$ (which may be the same or different) each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and $Y_1$ represents a hydrogen atom, a halogen atom, a carboxy group or a coupling releasable group capable of being released upon coupling by being bonded with the carbon atom at the coupling position through an oxygen atom, a nitrogen atom or a sulfur atom.

Alternatively, $R^8$, $R^9$, $R^{10}$ or $Y_1$ represents a divalent group forming a bis coupler. Further, the coupler represented by formula (IV), (V), (VI), (VII), (VIII) or (IX) may be in the form of a polymeric coupler in which the coupler constitutes a partial structure of a vinyl monomer and $R^8$, $R^9$ or $R^{10}$ represents a chemical bond or a connecting group, through which the partial structure of the formula (IV), (V), (VI), (VII), (VIII) or (IX) and the vinyl group are connected together.

In more detail, $R^8$, $R^9$ and $R^{10}$ each represents a hydrogen atom, a halogen atom (e.g., a chlorine atom, a bromine atom, etc.), an alkyl group (e.g., a methyl group, a propyl group, a tert-butyl group, a trifluoromethyl group, a tridecyl group, a 3-(2,4-di-tert-amylphenoxy)propyl group, a 2-dodecyloxyethyl group, a 3-phenoxypropyl group, a 2-hexylsulfonylethyl group, a cyclopentyl group, a benzyl group, etc.), an aryl group (e.g., a phenyl group, a 4-tert-butylphenyl group, a 2,4-di-tert-amylphenyl group, a 4-tetradecanamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-tert-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e g., a dodecylsulfonyloxy group, etc.), an acylamino group (e.g , an acetamido group, a benzamido group, a tetradecanamido group, an α-(2,4-di-tert-amylphenoxy)-butyramido group, a γ-(3-tert-butyl4-hydroxyphenoxy)butyramido group, an α-[4-(4-hydroxyphenylsulfonyl)phenoxy]decanamido group, etc.), an anilino group (e.g., a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-[α-(3-tert-butyl4-hydroxyphenoxy)dodecanamido]anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), an alkylthio group (e.g., a methylthio group, an octylthio group, a tetradecylthio group, a 2-phenoxyethylthio group, a 3-phenoxypropylthio group, a 3-(4-tert-butylphenoxy)propylthio group, etc.), an arylthio group (e.g., a phenylthio group, a 2-butoxy-5-tertoctylphenylthio group, a 3-pentadecylphenylthio group, a 2-carboxyphenylthio group, a 4-tetradecanamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-tert-butylphenoxycarbonylamino group, etc ), a sulfonamido group (e.g., a methanesulfonamido group, a hexadecanesulfonamido group, a benzenesulfonamido group, a p-toluenesulfonamido group, an octadecanesulfonamido group, a 2-methyloxy-5-tert-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-tert-amylphenoxy)propyl]carbamoyl group, etc.), an acyl group (e.g., an acetyl group, a (2,4-di-tert-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecylcarbonyl group, an octadecylcarbonyl group, etc.) or an aryloxycarbonyl group (e.g., a phenyloxycarbonyl group, a 3-pentadecyloxycarbonyl group, etc.); and $Y_1$ represents a hydrogen atom; a halogen atom (e.g , a chlorine atom, a bromine atom, an iodine atom, etc.); a carboxy group; a group bonded to the coupling position through an oxygen atom (e.g., an acetoxy group, a propanoyloxy group, a benzoyloxy group, a 2,4-dichlorobenzoyloxy group, an ethoxyoxaloyloxy group, a pyruvinyloyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group, etc.); a group bonded to the coupling position through a nitrogen atom (e.g., a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzylethoxy-3-hydantoinyl group, a 2N-1,1-dioxo-3(2H)-oxo1,2-benzisothiazolyl group, a 2-oxo-1,2-dihydro-1-pyridinyl group, an imidazolyl group, a pyrazolyl group, a 3,5-diethyl-1,2,4-triazol-1-yl group, a 5- or 6-bromobenzotriazol-1-yl group, a 5-methyl-1,2,4-triazol-1-yl group, a benzimidazolyl group, a 3-benzyl-1-hydantoinyl group, a 1-benzyl-5-hexadecyloxy-3-hydantoinyl group, a 5-methyl-1-tetrazolyl group, a 4-methoxyphenylazo group, a 4-pivaloylaminophenylazo group, a 2-hydroxy-4-propanoylphenylazo group, etc.; or a group bonded to the coupling position through a sulfur atom (e.g., a phenylthio group, a 2-carboxyphenylthio group, a 2-methoxy-5-tert-octylphenylthio group, a 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazolyl-5-thio group, etc.).

When $R^8$, $R^9$, $R^{10}$ or $Y_1$ each represents a divalent group to form a bis coupler, such a divalent group includes a substituted or unsubstituted alkylene group (e.g., a methylene group, an ethylene group, a 1,10-decylene group, —$CH_2CH_2$—O—$CH_2CH_2$—, etc.), a substituted or unsubstituted phenylene group (e.g., a 1,4-phenylene group, a 1,3-phenylene group,

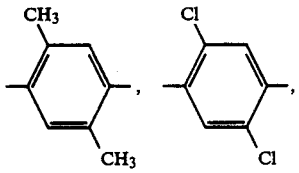

etc.), an —NHCO—$R^{20}$— group (wherein $R^{20}$ represents a substituted or unsubstituted alkylene or phenylene group), or a —CONH— group.

The connecting group represented by $R^8$, $R^9$ or $R^{10}$ in the cases wherein the coupler moiety represented by formula (IV), (V), (VI), (VII), (VIII) or (IX) is included in a vinyl monomer includes an alkylene group (including a substituted or unsubstituted alkylene group, e.g., a methylene group, an ethylene group, a 1,10-decylene group, —$CH_2CH_2$—O—$CH_2CH_2$—, etc.), a phenylene group (including a substituted or unsubstituted phenylene group, e.g., a 1,4-phenylene group, a 1,3-phenylene group,

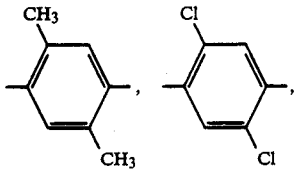

etc.), —NHCO—, —CONH—, —O—, —OCO—, and an aralkylene group (e.g.,

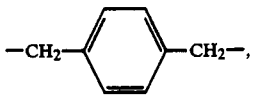

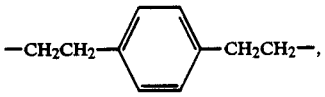

-continued

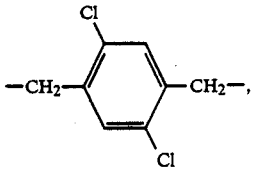

etc.), or a combination thereof.

Further, a vinyl group in the vinyl monomer may further have other substituents in addition to the coupler moiety represented by formula (IV), (V), (VI), (VII), (VIII) or (IX). Preferred examples of the substituents include a hydrogen atom, a chlorine atom or a lower alkyl group having from 1 to 4 carbon atoms.

Examples of non-color-forming ethylenically unsaturated monomers which do not undergo coupling with the oxidation product of an aromatic primary amine developing agent include acrylic acid and derivatives thereof such as acrylic acid, α-chloroacrylic acid, α-aracrylic acid (e.g., methacrylic acid, etc.), etc., an ester or an amide derived from these acrylic acids (e.g., acrylamide, n-butylacrylamide, tert-butylacrylamide, diacetonacrylamide, methacrylamide, methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methyl methacrylate, ethyl methacrylate, n-butyl methacrylate, β-hydroxyethyl methacrylate, etc.), methylenebisacrylamide, a vinyl ester (e.g., vinyl acetate, vinyl propionate, vinyl laurate, etc.), acrylonitrile, methacrylonitrile, an aromatic vinyl compound (e.g., styrene and derivatives thereof, vinyltoluene, divinylbenzene, vinylacetophenone, sulfostyrene, etc.), itaconic acid, citraconic acid, crotonic acid, vinylidene chloride, a vinyl alkyl ether (e.g., vinyl ethyl ether, etc.), maleic acid, maleic anhydride, a maleic acid ester, N-vinyl-2-pyrrolidone, N-vinylpyridine, 2- or 4-vinylpyridine, etc.

Two or more non-color-forming ethylenically unsaturated monomers can be used together.

Specific examples of the magenta couplers represented by formulae (IV), (V), (VI), (VII), (VIII) and (IX) which can be used in the present invention and methods for synthesis thereof are described in the following literature.

The compounds of formula (IV) are described in Japanese Patent Application (OPI) No. 162548/84, etc., the compounds of formula (V) are described in Japanese Patent Application (OPI) No. 43659/85, etc., the compounds of formula (VI) are described in Japanese Patent Publication No. 27411/72, etc., the compounds of formula (VII) are described in Japanese Patent Application (OPI) Nos. 171956/84 and 172982/85, etc., the compounds of formula (VIII) are described in Japanese Patent Application (OPI) No. 33552/85, etc., and the compounds of formula (IX) are described in U.S. Pat. No. 3,061,432, etc., respectively.

In addition, highly color-forming ballast groups as described, for example, in Japanese Patent Application (OPI) Nos. 42045/83, 214854/84, 177553/84, 177554/84 and 177557/84, etc., can be applied to any of the compounds represented by formula (IV), (V), (VI), (VII), (VIII) or (IX) described above.

Specific examples of the pyrazoloazole type couplers which can be employed in the present invention are set forth below, but the present invention should not be construed as being limited thereto.

(M-1)
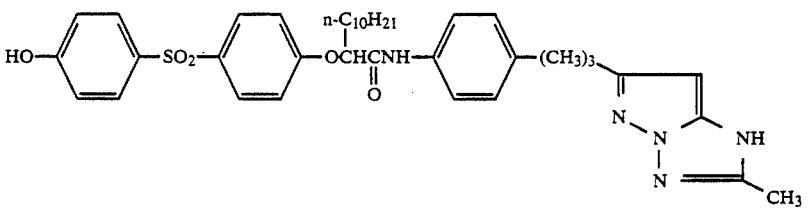
(M-2)
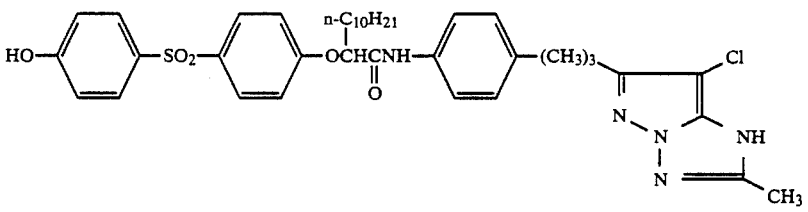
(M-3)
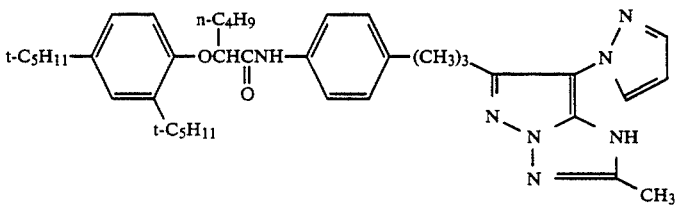
(M-4)
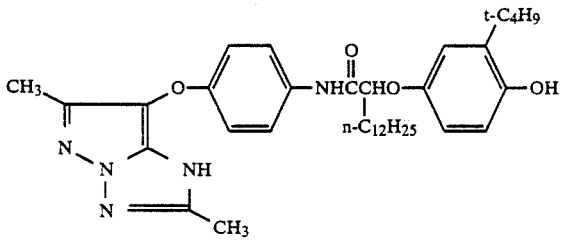
(M-5)
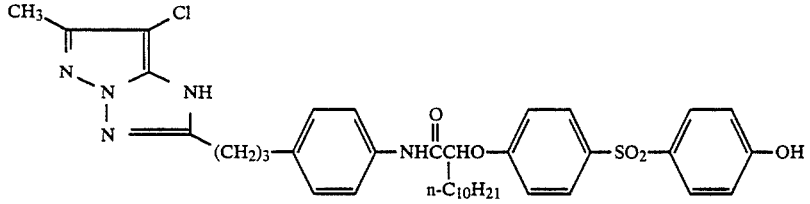
(M-6)
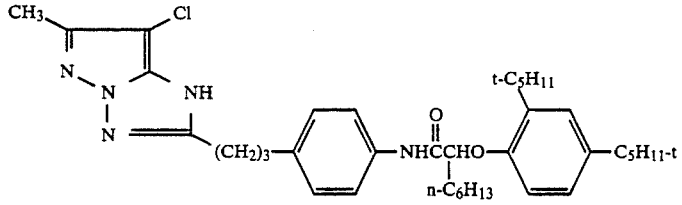
(M-7)
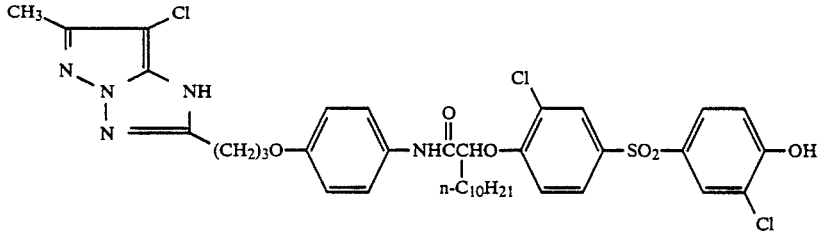

-continued
(M-8)
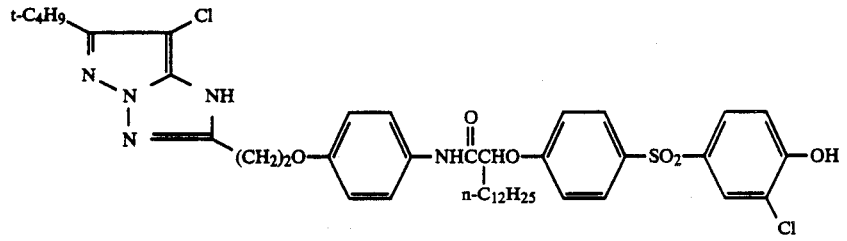
(M-9)
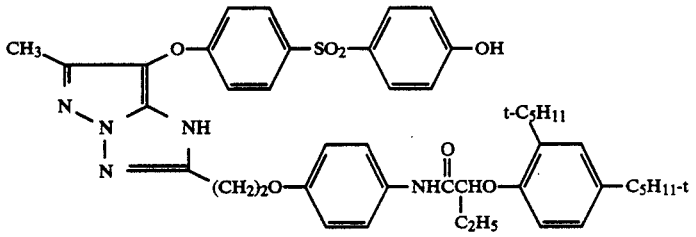
(M-10)
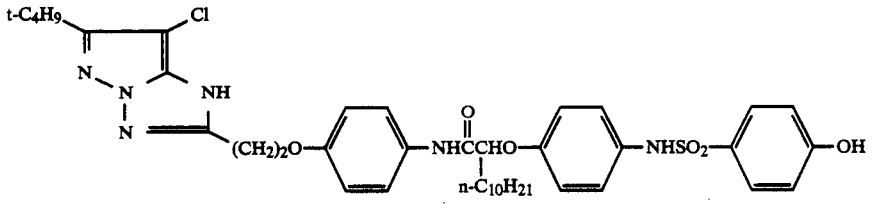
(M-11)
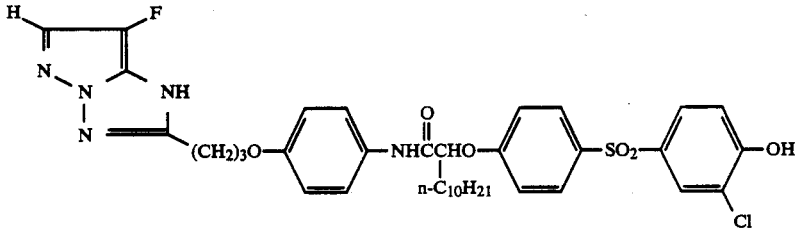
(M-12)
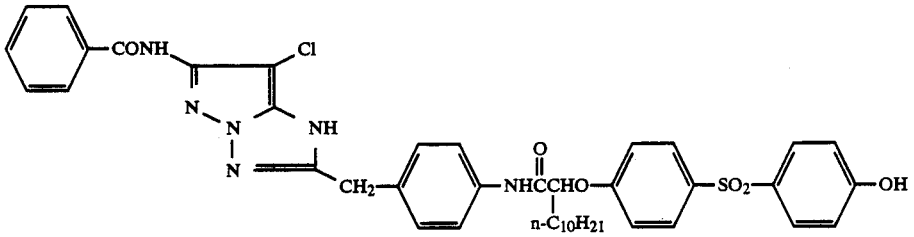
(M-13)
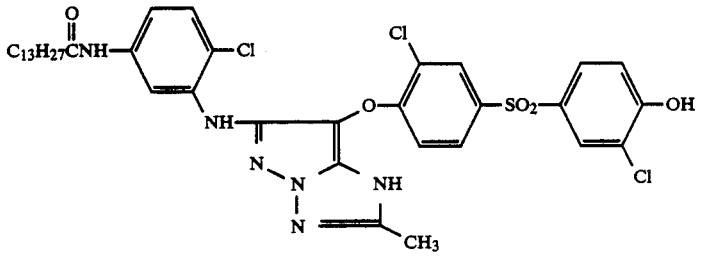

-continued
(M-14)
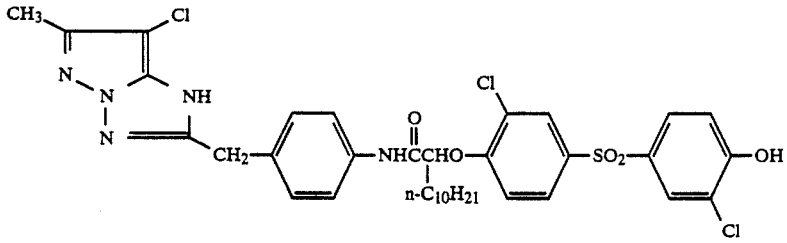
(M-15)
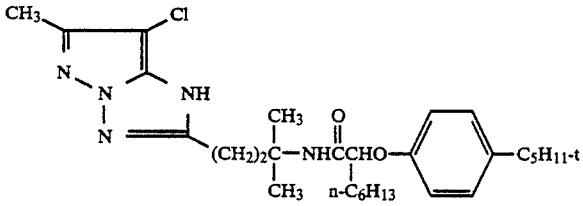
(M-16)
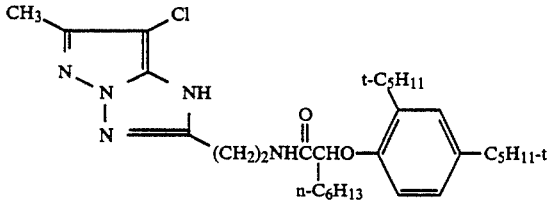
(M-17)
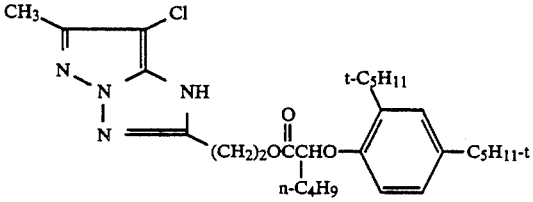
(M-18)
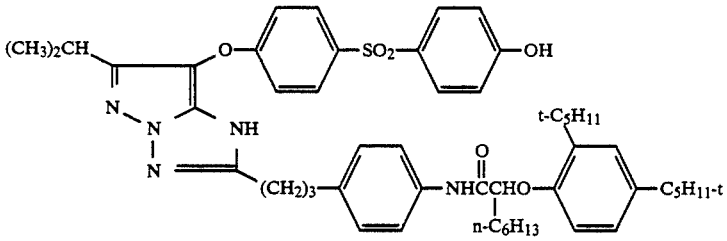
(M-19)
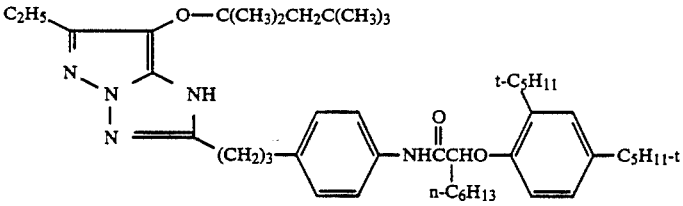
(M-20)
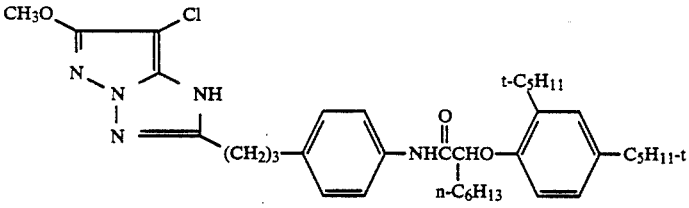

-continued
(M-21)
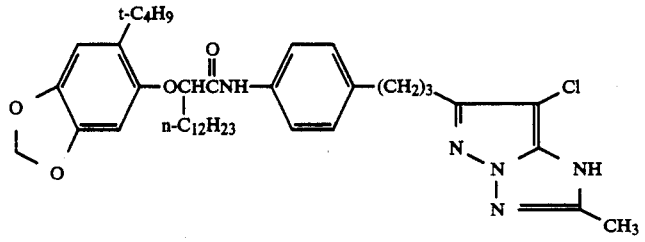
(M-22)
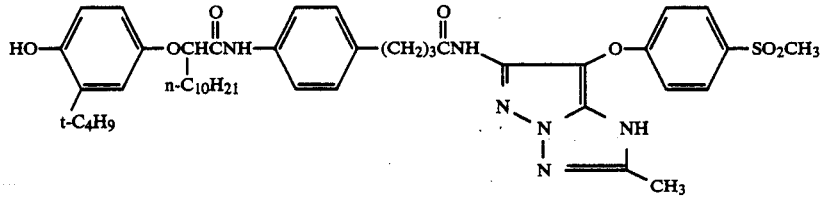
(M-23)
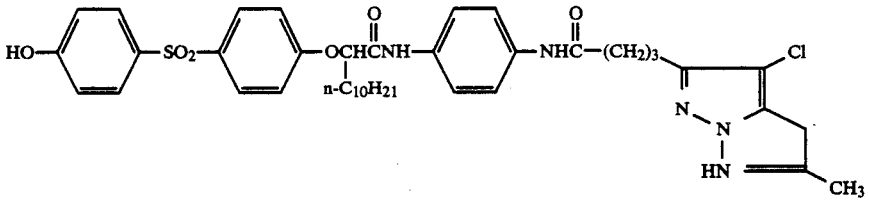
(M-24)
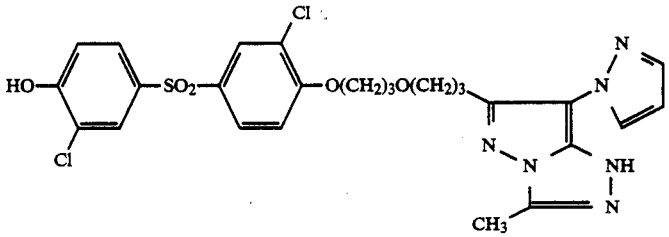
(M-25)
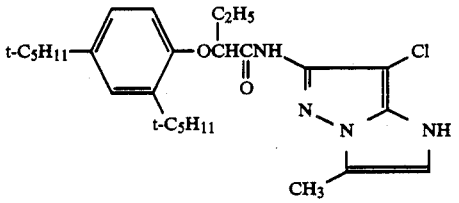
(M-26)
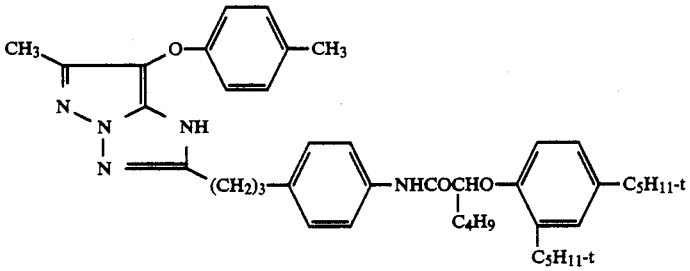

-continued
(M-27)
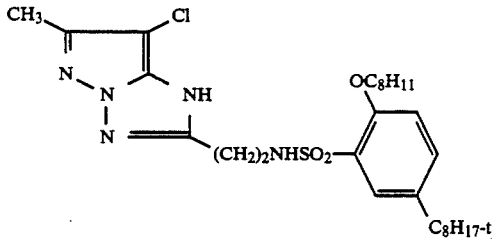
(M-28)
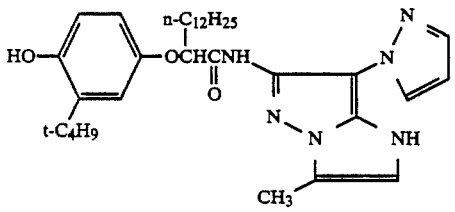
(M-29)
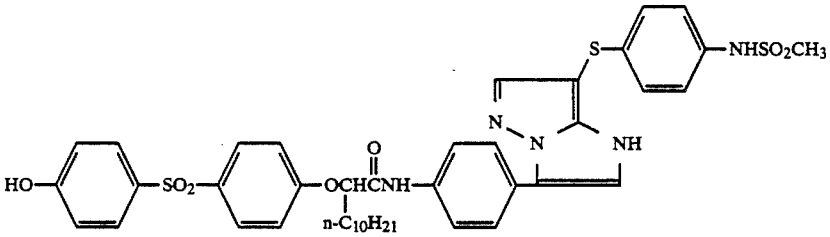
(M-30)
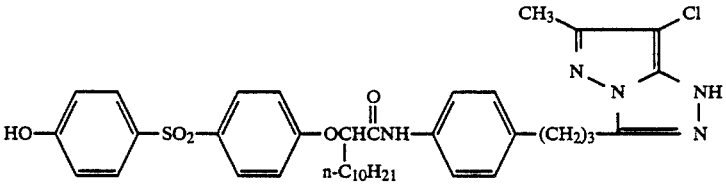
(M-31)
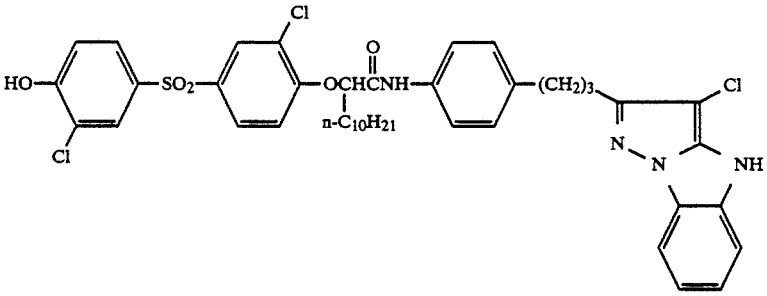
(M-32)
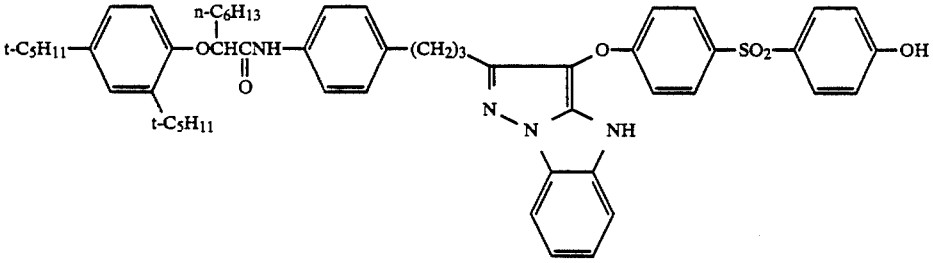

-continued
(M-33)
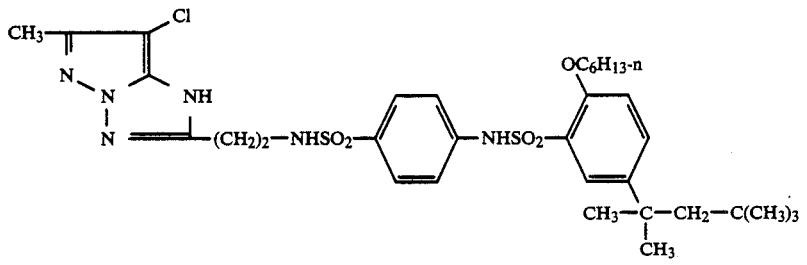
(M-34)
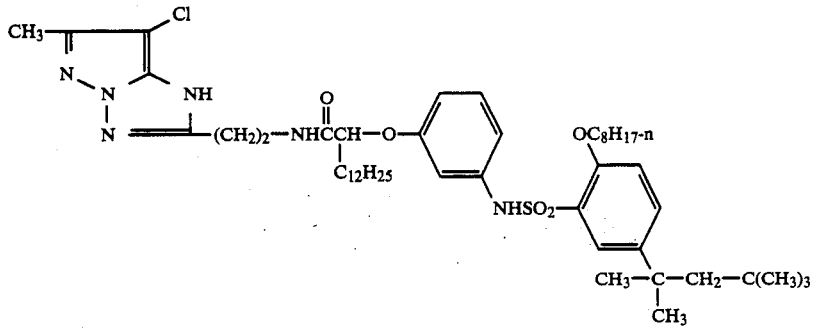
(M-35)
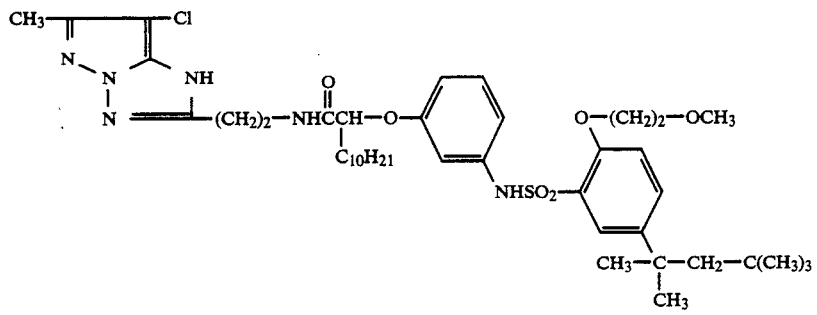
(M-36)
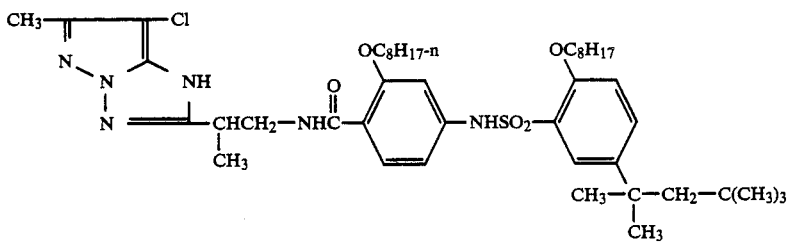
(M-37)
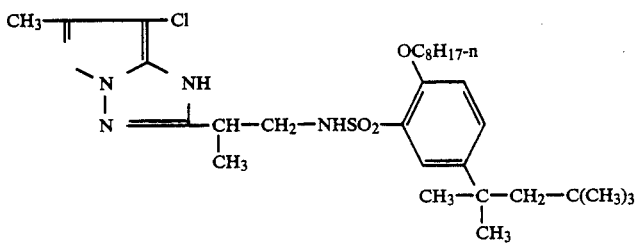
(M-38)
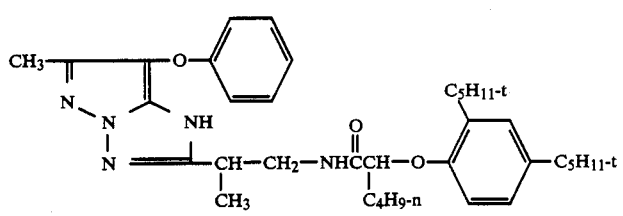

-continued
(M-39)
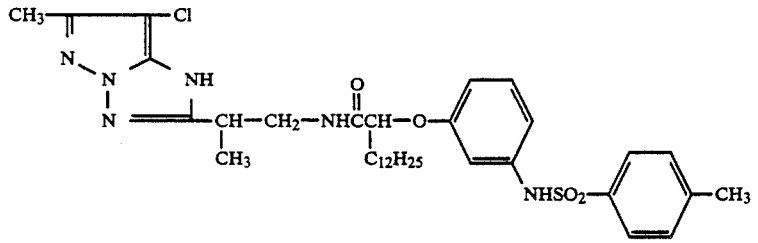
(M-40)
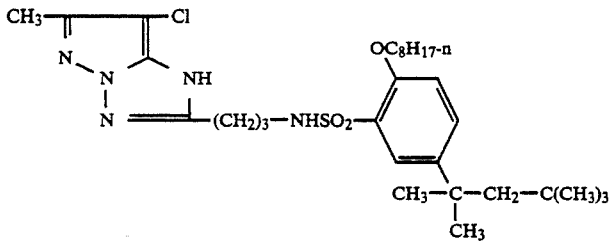
(M-41)
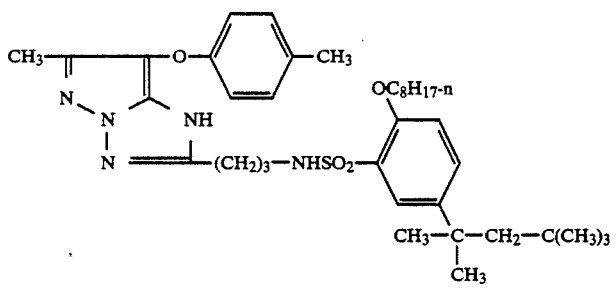
(M-42)
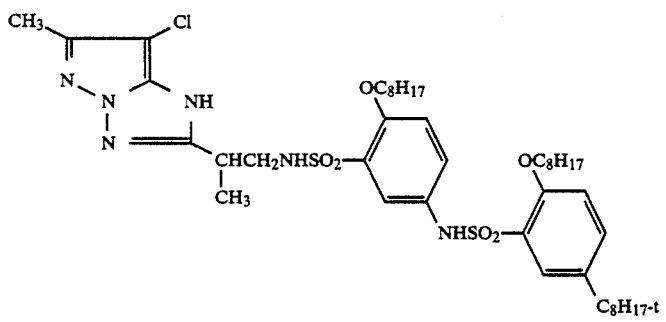
(M-43)
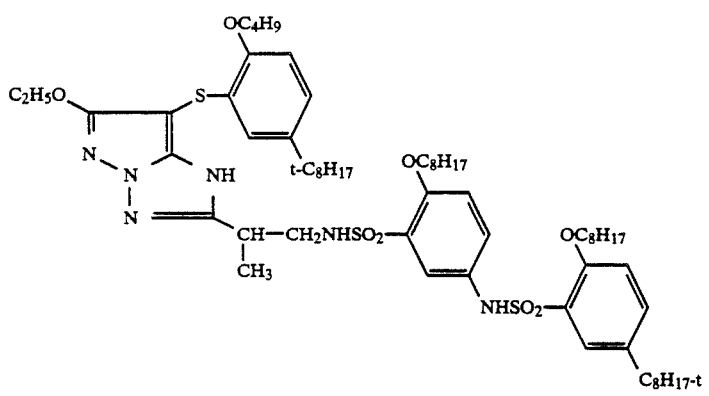

-continued
(M-44)
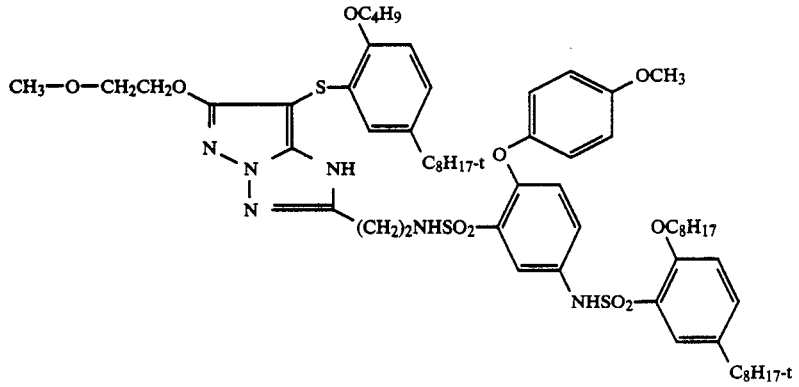
(M-45)
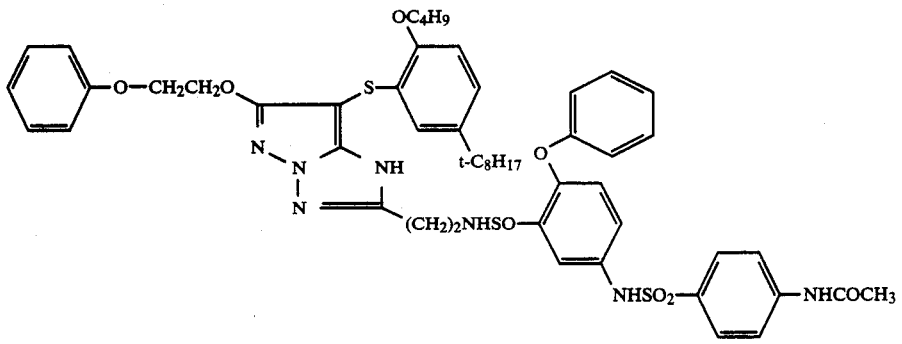
(M-46)
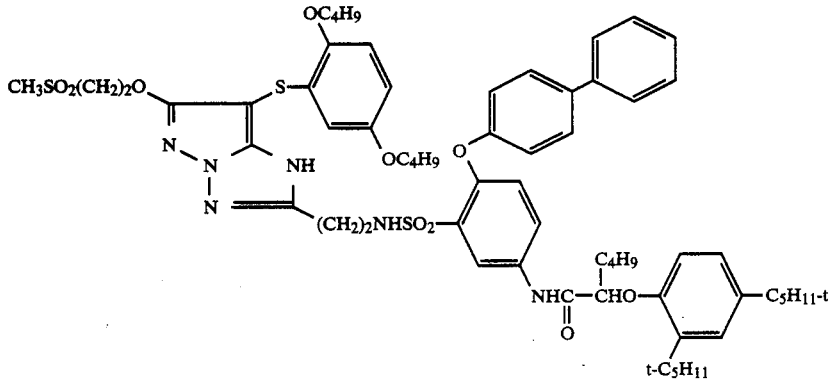
(M-47)
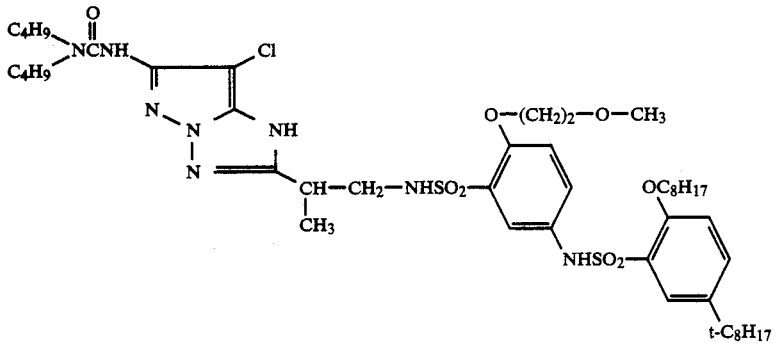

-continued
(M-48)
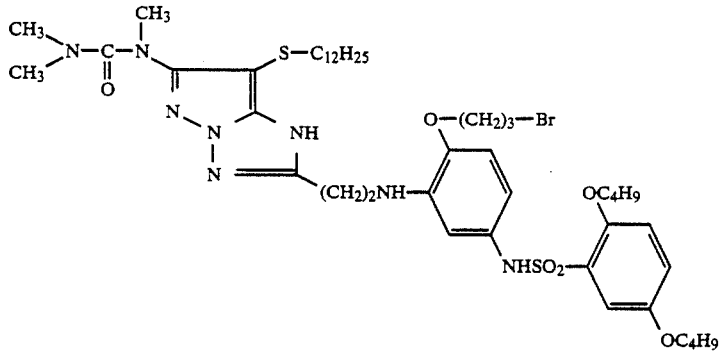
(M-49)
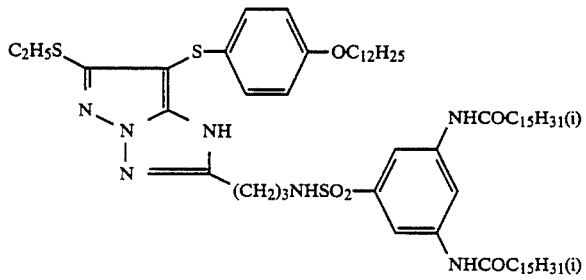
(M-50)
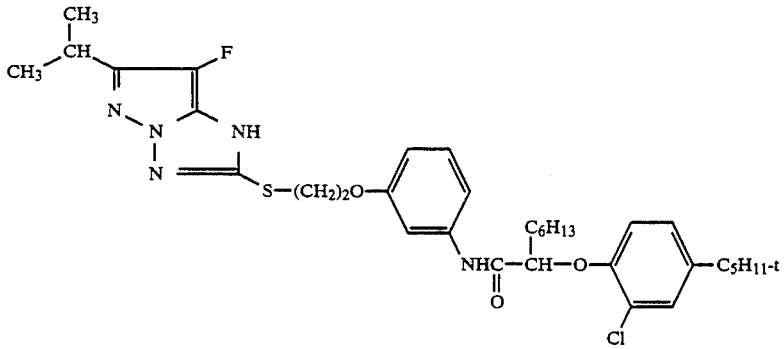
(M-51)
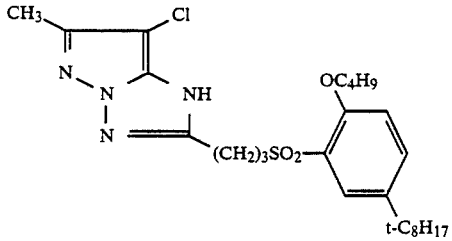
(M-52)
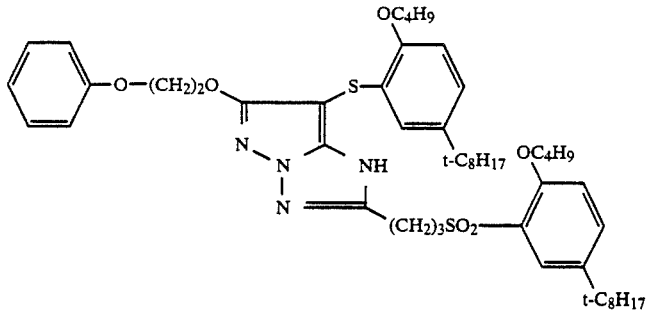

-continued
(M-53)
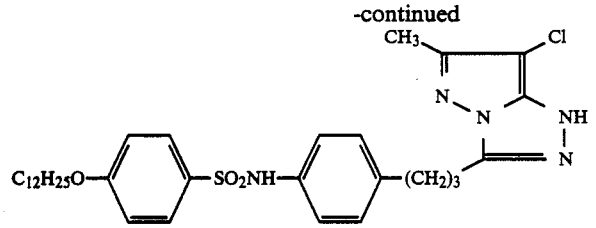
(M-54)
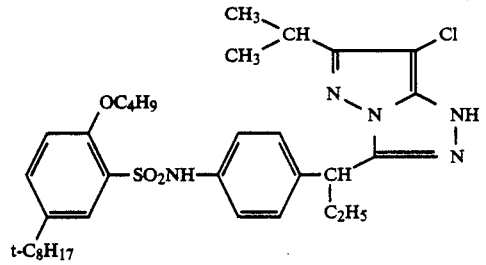
(M-55)
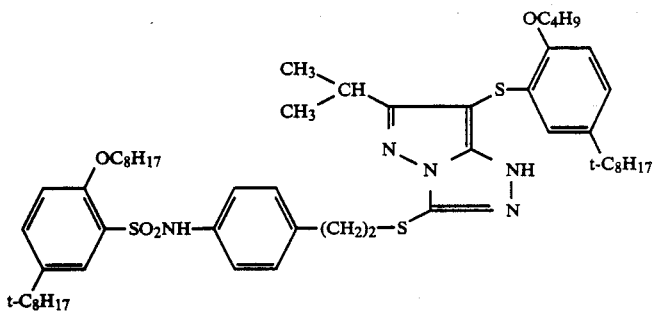
(M-56)
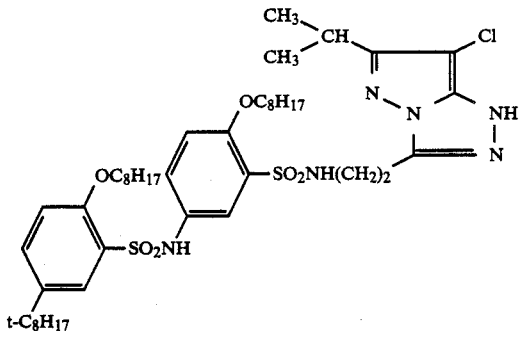
(M-57)
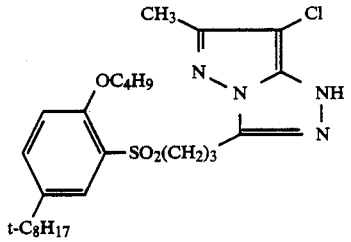
(M-58)
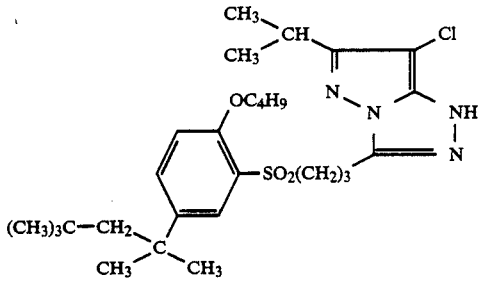

-continued
(M-59)
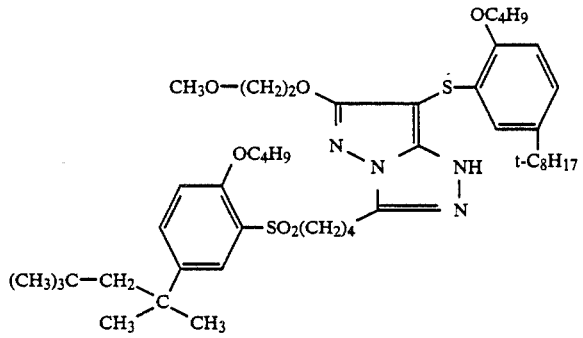
(M-60)
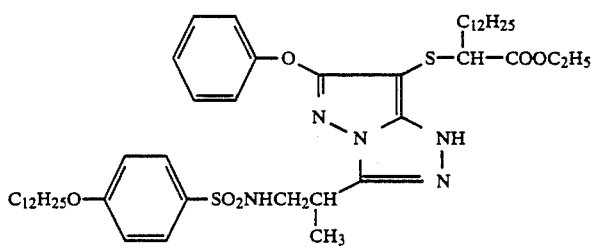
(M-61)
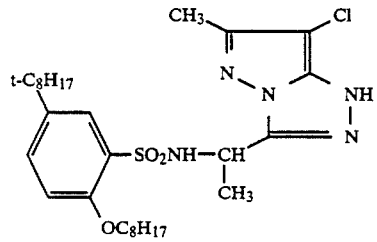
(M-62)
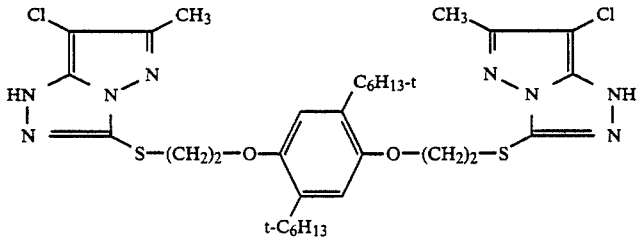
(M-63)
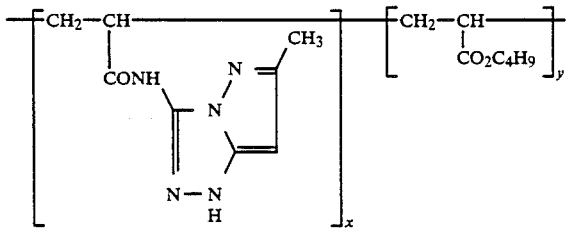
x/y = 50/50 (weight ratio)
(M-64)
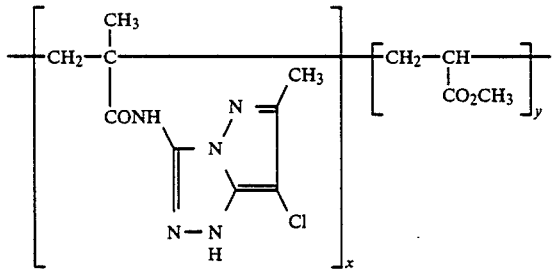
x/y = 40/60

-continued (M-65)

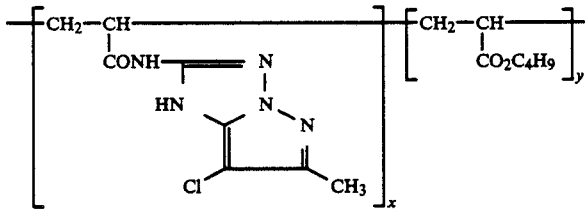

x/y = 50/50

(M-66)

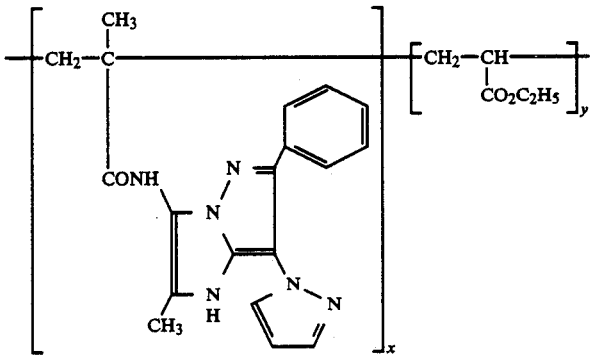

x/y = 55/45

(M-67)

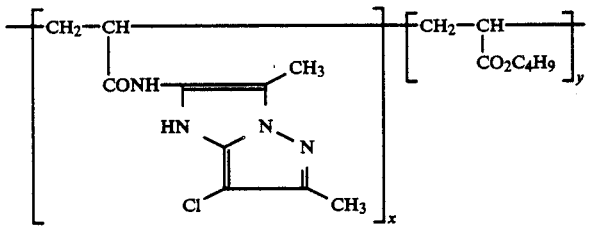

x/y = 50/50

The coupler may be incorporated into a silver halide emulsion layer in an amount of from $2\times10^{-3}$ to $5\times10^{-1}$ mol, and preferably from $1\times10^{-2}$ to $5\times10^{-1}$ mol, per mol of silver present in the emulsion layer.

In order to fulfill characteristics required for the light-sensitive material, two or more kinds of the couplers, etc., described above can be incorporated into the same layer, or the same compound may be incorporated into two or more layers.

In order to introduce couplers into a silver halide emulsion layer, known methods, for example, the method as described in U.S. Pat. No. 2,322,027, can be utilized. For example, they can be dissolved into a solvent and then dispersed into a hydrophilic colloid. Examples of solvents usable for this method include organic solvents having a high boiling point, such as alkyl esters of phthalic acid (e.g., dibutyl phthalate, dioctyl phthalate, etc.), phosphonic acid esters (e.g., diphenyl phosphate, triphenyl phosphate, tricresyl phosphate, dioctylbutyl phosphate, etc.), citric acid esters (e.g., tributyl acetylcitrate, etc.), benzoic acid esters (e.g., octyl benzoate, etc.), alkylamides (e.g., diethyllaurylamides, etc.), fatty acid esters (e.g., dibutoxyethyl succinate, diethyl azelate, etc.) and trimesic acid esters (e.g., tributyl trimesate, etc.); organic solvents having a boiling point of from about 30° to about 150° C., such as lower alkyl acetates (e.g., ethyl acetate, butyl acetate, etc.), ethyl propionate, secondary butyl alcohol, methyl isobutyl ketone, β-ethoxyethyl acetate, methyl cellosolve acetate; and the like. Mixtures of the organic solvents having a high boiling point described above and the organic solvents having a low boiling point described above can also be used.

The reflective support which can be employed in ths present invention is a support having an increased reflection property for the purpose of rendering dye images formed in the silver halide emulsion layer clear. Examples of the reflective support include a support having coated thereon a hydrophobic resin containing a light reflective substance such as titanium oxide, zinc oxide, calcium carbonate, calcium sulfate, etc., dispersed therein and a support composed of a hydrophobic resin containing a light reflective substance dispersed therein. More specifically, they include baryta coated paper, polyethylene coated paper, polypropylene type synthetic paper, a transparent support, for example, a glass plate, a polyester film such as a polyethylene terephthalate film, a cellulose triacetate film, a cellulose nitrate film, etc., a polyamide film, a polycarbonate film, a polystyrene film, etc., having a reflective layer or having a reflective substance incorporated therein. A suitable support can be appropriately selected depending on the purpose.

The color developing solution which can be used in the present invention is characterized by substantially not containing benzyl alcohol. The term "not substantially containing" means that the color developing solution contains benzyl alcohol in a concentration of 2.0 mϕl or less per liter of the color developing solution. It is preferred that the color developing solution does not contain benzyl alcohol at all.

According to the method of the present invention, a period of the color developing time is up to 2 minutes and 30 seconds, preferably from 20 seconds to 2 minutes and 30 seconds, and more preferably from 40 seconds to 2 minutes and 00 seconds. The term "color developing time" means a period from the time when the photographic light-sensitive material comes into contact with the color developing solution to the time when the photographic material comes into contact with the following processing solution. That is, it includes the so-called transfer time.

A color developing solution used for development processing of the photographic light-sensitive material according to the present invention is preferably an alkaline aqueous solution containing an aromatic primary amine color developing agent as a main component. As a color developing agent, a p-phenylenediamine type compound is preferably used. Typical examples of the p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, or a sulfate, hydrochloride or p-toluenesulfonate thereof, etc.

The pH of the color developing solution which can be used in the present invention is preferably from 9 to 12, and more preferably from 9 to 11.0.

The color developing solution may further contain other known developing solution components.

For example, the color developing solution used in the present invention further contains an alkali agent or a pH buffer such as sodium hydroxide, potassium hydroxide, sodium carbonate, potassium carbonate, sodium tertiary phosphate, potassium tertiary phosphate, potassium metaphosphate, borax, etc., singly or as a combination thereof. Furthermore, for imparting a buffer function to the color developing solution, facilitating the preparation of the developing solution, or increasing the ionic strength of the developing solution, various salts such as disodium hydrogenphosphate, dipotassium hydrogenphosphate, sodium dihydrogenphosphate, potassium dihydrogenphosphate, sodium hydrogencarbonate, potassium hydrogencarbonate, borate, an alkali nitrate, an alkali sulfate, etc.

Furthermore, the color developing solution used in the present invention may contain various chelating agents for preventing precipitation of calcium or magnesium in the color developing solution. Examples of the chelating agents include polyphosphates, aminopolycarboxylic acids, phosphonocarboxylic acids, aminopolyphosphonic acids, 1-hydroxyalkylidene-1,1-diphosphonic acids, etc.

Moreover, the color developing solution used in the present invention can contain, if desired, an appropriate development accelerator. Examples of such development accelerators include the various pyridinium compounds and other cationic compounds as described, for example, in U.S. Pat. Nos. 2,648,604 and 3,171,247, Japanese Patent Publication No. 9503/69; cationic dyes such as phenosafranine, etc.; neutral salts such as thallium nitrate, potassium nitrate, etc.; polyethylene glycol and the derivatives thereof described in Japanese Patent Publication No. 9304/69, U.S. Pat. Nos. 2,533,990, 2,531,832, 2,950,970 and 2,577,127; nonionic compounds such as polythioethers; a thioether type compound described in U.S. Pat. No. 3,201,242; and the like.

Also, the color developing solution used in the present invention may contain, if desired, a sulfite such as sodium sulfite, potassium sulfite, potassium hydrogensulfite, sodium hydrogensulfite, etc., ordinarily used as a preservative. It is desired that the amount of such a compound is small as far as the preservability is maintained. More specifically, it ranges preferably from 0 to about 5 g, and more preferably from 0 to about 3 g, per liter of the color developing solution.

Further, the color developing solution used in the present invention may contain a hydroxylamine as a preservative. Examples of the hydroxylamines include hydroxylamine, N,N-dimethylhydroxylamine, N,N-diethylhydroxylamine, N,N-di(methoxyethyl)hydroxylamine, etc. They may be used in the form of a salt with an acid. It is desirable that the amount of such a hydroxylamine is small as is necessary such that preservability is maintained. More specifically, it typically ranges from 0 to 10 g, and preferably from 0 to 6 g, per liter of the color developing solution.

Furthermore, the color developing solution used in the present invention may contain, if desired, an appropriate antifoggant. As the antifoggant for use in the present invention, there are alkali metal halides such as potassium bromide, sodium chloride, potassium iodide, etc., and organic antifoggants. Two or more kinds of these antifoggants may be employed in a combination. It is preferred to use the antifoggant in a small amount provided that fog is prevented.

Examples of the organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, hydroxyazaindolizine, etc.; mercaptosubstituted heterocyclic compounds such as 1-phenyl-5-mercaptotetrazole, 2-mercaptobenzimidazole, 2-mercaptobenzothiazole, etc.; and mercapto-substituted aromatic compounds such as thiosalicylic acid, etc. Of these compounds, the nitrogen-containing heterocyclic compounds are particularly preferred. These antifoggants may be used in such a manner that they are dissolved from color photographic light-sensitive materials in a color developing solution during processing and accumulated in the color developing solution.

After color development, the photographic emulsion layer is usually subjected to a bleach processing. The bleach processing may be performed simultaneously with a fix processing, or they may be performed independently.

Bleaching agents which can be used include compounds of polyvalent metals, for example iron (III), cobalt (III), chromium (VI), and copper (II), peracids, quinones and nitroso compounds. For example, ferricyanides; dichromates; organic complex salts of iron (III) or cobalt (III), for example, complex salts of aminopolycarboxylic acids (e.g., ethylenediaminetetraacetic acid, diethylenetriaminepentaacetic acid, nitrilotriacetic acid, 1,3-diamino-2-propanoltetraacetic acid, etc.) or organic acids (e.g., citric acid, tartaric acid, malic acid, etc.); persulfates; manganates; nitrosophenol; etc., can be typically used. Of these compounds, the following bleaching agents are preferred.

Ethylenediaminetetraacetic acid iron (III) complex salt

Diethylenetriaminepentaacetic acid iron (III) complex salt

Methyliminodiacetic acid iron (III) complex salt

Cyclohexanediaminetetraacetic acid iron (III) complex salt 1,3-Diaminopropanetetraacetic acid iron (III) complex salt The pH of the bleaching solution or the bleach-fixing solution used is preferably from 3 to 9, and more preferably from 4 to 8. In order to adjust pH, various acids such as hydrochloric acid, nitric acid, sulfuric acid, phosphoric acid, acetic acid, citric acid, etc., or an alkali such as sodium hydroxide, ammonia, etc., may be added to the bleaching solution or the bleach-fixing solution, if desired.

In the bleaching solution or the bleach-fixing solution, various kinds of accelerators may be employed together, if desired.

After the bleach-fixing processing or the fixing processing, water washing processing is usually carried out. In the water washing step, various known compounds may be employed for the purpose of preventing precipitation or saving water, etc. For example, a water softener such as an inorganic phosphoric acid, an aminopolycarboxylic acid or an organic phosphoric acid, etc., for preventing precipitation; a germicide or fungicide for preventing the propagation of various bacteria, algae and fungi; a hardening agent such as a magnesium salt or an aluminum salt, etc.; or a surface active agent for reducing drying load or preventing drying uneven finishing, or the like may be added, if desired. Further, the compound as described in L. E. West, *Phot. Sci. and Eng.*, Vol. 6, pp. 344–359 (1965) may be added. Particularly, the addition of chelating agents and fungicides is effective.

The water washing step is ordinarily carried out using a countercurrent water washing processing with two or more tanks in order to save water. Further, in place of the water washing step, a multistage countercurrent stabilizing processing step as described in Japanese Patent Application (OPI) No. 8543/82 may be conducted. To the stabilizing bath various kinds of compounds are added for the purpose of stabilizing images formed. Representative examples of the additives include various buffers (for example, borates, metaborates, borax, phosphates, carbonates, potassium hydroxide, sodium hydroxide, aqueous ammonia, monocarboxylic acids, dicarboxylic acids, polycarboxylic acids, etc., being used in combination) for the purpose of adjusting the pH of layers (for example, pH of 3 to 8), formalin, etc. In addition, various additives, for example, water softeners (for example, inorganic phosphoric acids, aminopolycarboxylic acids, organic phosphoric acids, aminopolyphosphonic acids, phosphonocarboxylic acids, etc.), germicides (for example, benzoisothiazolinones, isothiazolones, 4-thiazolinebenzimidazoles, halogenated phenols, etc.), surface active agents, brightening agents, hardening agents, etc., may be employed, if desired. Two or more compounds for the same or different purposes may be employed together.

Further, it is preferred to add various ammonium salts such as ammonium chloride, ammonium nitrate, ammonium sulfate, ammonium phosphate, ammonium sulfite, ammonium thiosulfate, etc., as pH adjusting agent for layers after processing.

For the purpose of simplification and acceleration of processing, a color developing agent may be incorporated into the silver halide color photographic material of the present invention. In order to incorporate the color developing agent, it is preferred to employ various precursors of color developing agents.

Further, the silver halide color photographic material of the present invention may contain various 1-phenyl-3-pyrazolidones for the purpose of accelerating color development, if desired. Typical examples of the compounds are described in Japanese Patent Application (OPI) Nos. 64339/81, 144547/82, 211147/82, 50532/83, 50536/83, 50533/83, 50534/83, 50535/83 and 115438/83, etc.

Various kinds of processing solutions are employed in a temperature range from 10° C. to 50° C. in the present invention. It is standard to carry out processing at a temperature range from 33° C. to 38° C. However, it is possible to conduct processing at a higher temperature in order to facilitate processing and to reduce processing time. On the contrary, processing may be carried out at a lower temperature in order to achieve improvement in image quality and stability of processing solutions.

Moreover, the photographic processing may be conducted utilizing color intensification using cobalt or hydrogen peroxides as described in West German Patent 2,226,770 and U.S. Pat. No. 3,674,499, etc., for the purpose of saving an amount of silver employed in the photographic light-sensitive material.

In each of the processing baths, a heater, a temperature sensor, a liquid surface sensor, a circulation pump, a filter, a floating cover, a squeegee, etc., may be provided, if desired.

The silver halide emulsion which is used in the emulsion layer of the silver halide color photographic material of the present invention is usually prepared by mixing an aqueous solution of a water-soluble silver salt (for example, silver nitrate) with an aqueous solution of a water-soluble halogen salt (for example, potassium bromide, sodium chloride, potassium iodide or a mixture thereof) in the presence of an aqueous solution of a water-soluble polymer (for example, gelatin, etc.).

Silver halide which is preferably used in the present invention includes silver bromide, silver chlorobromide and silver chloride, each of which does not substantially contain silver iodide. More preferred silver halide is silver chlorobromide containing from 2 to 99.5 mol% of silver chloride. In order to obtain an emulsion having a sufficiently high sensitivity without increase in fog, it is desired that the silver bromide content is 20 mol% or more. However, when promptness of development is required, a silver bromide content of 20 mol% or less, and preferably 10 mol% or less, in some cases, is employed. In the case of reducing the silver bromide content, not only the promptness of development of silver halide is improved, but also when photographic light-sensitive materials containing such silver halide are continuously developed, accumulation of bromide ions in a developing solution is controlled and the developing solution becomes highly active. Therefore, such silver halide is particularly preferred for rapid processing.

Silver halide grains may have different layers in the inner portion and the surface portion, have multiphase structures containing junctions, or may be uniform throughout the grains. Further, a mixture of silver halide grains having different structures may be employed. For instance, with respect to silver chlorobromide grains having different phases, examples include those having nuclei which are rich in silver bromide as compared with the mean halogen composition or a single layer or plural layers, or those having nuclei which are rich in silver chloride as compared with the mean halogen composition or a single layer or plural layers.

Average grain size of silver halide grains (the grain size being defined as grain diameter if the grain has a spherical or a nearly spherical form, and as the length of an edge if the grain has a cubic form, being averaged based on project areas of the grains) is preferably from 0.1 μm to 2 μm, and particularly from 0.15 μm to 1 μm. Grain size distribution may be either narrow or broad.

A so-called monodispersed silver halide emulsion having a narrow grain size distribution can be employed in the present invention. The monodispersed silver halide emulsion is a silver halide emulsion in which at least 90%, and preferably 95%, by weight or by number of the total silver halide grains have a size within the range of ±40% of the average grain size.

Further, in order to achieve the desired gradation of the light-sensitive material, two or more monodispersed silver halide emulsions which have different grain sizes from each other can be mixed in one emulsion layer or can be coated in the form of superimposed layers which have substantially the same spectral sensitivity. Moreover, two or more polydispersed silver halide emulsions or combinations of a monodispersed emulsion and a polydispersed emulsion may be employed in a mixture or in the form of superimposed layers.

Silver halide grains which can be used in the present invention may have a regular crystal form, for example, a cubic, octahedral, dodecahedral or tetradecahedral form, etc., an irregular crystal form, for example, a spherical form, etc., or a composite form thereof. Further, tabular silver halide grains can be used. Particularly, a silver halide emulsion wherein tabular silver halide grains having a ratio of diameter/thickness of not less than 5, preferably not less than 8, account for at least 50% of the total project area of the silver halide grains present can be employed. In addition, mixtures of silver halide grains having different crystal forms may be used. These silver halide emulsions may be those of surface latent image type in which latent images are formed mainly on the surface thereof, those of internal latent image type in which latent images are formed mainly in the inside thereof.

Photographic emulsion as used in the present invention can be prepared in any suitable manner, for example, by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). That is, any of an acid process, a neutral process, an ammonia process, etc., can be employed.

Soluble silver salts and soluble halogen salts can be reacted by techniques such as a single jet method, a double jet method, and a combination thereof. In addition, there can be employed a method (so-called reverse mixing method) in which silver halide grains are formed in the presence of an excess of silver ions. A conversion method wherein a halogen salt which can form more insoluble silver halide is added may also be used. As one system of the double jet method, a so-called controlled double jet method in which the pAg in a liquid phase where silver halide is formed is maintained at a constant level can be employed. This method can prepare a silver halide emulsion in which the crystal form is regular and the particle size is nearly uniform.

During the step of formation or physical ripening of silver halide grains, cadmium salts, zinc salts, lead salts, thallium salts, iridium salts or complex salts thereof, rhodium salts or complex salts thereof, iron salts or complex salts thereof, etc., may be present.

After the formation of silver halide grains, silver halide emulsions are usually subjected to physical ripening, removal of soluble salts and chemical ripening, and then employed for coating.

Known silver halide solvents (for example, ammonia, potassium thiocyanate, and thioethers and thione compounds described in U.S. Patent No. 3,271,157, Japanese Patent Application (OPI) Nos. 12360/76, 82408/78, 144319/78, 100717/79 and 155828/79, etc.) can be employed during the step of formation, physical ripening or chemical ripening of silver halide.

For removal of soluble salts from the emulsion after physical ripening, a noodle washing process, a flocculation settling process, an ultrafiltration process, etc., can be employed.

To the silver halide emulsion which can be used in the present invention, a sulfur sensitization method using active gelatin or compounds containing sulfur capable of reacting with silver (for example, thiosulfates, thioureas, mercapto compounds and rhodanines, etc.), a reduction sensitization method using reducing substances (for example, stannous salts, amines, hydrazine derivatives, formamidinesulfinic acid and silane compounds, etc.), a noble metal sensitization method using noble metal compounds (for example, complex salts of Group VIII metals in the Periodic Table, such as Pt, Ir, Pd, Rh, Fe, etc., as well as gold complex salts); and so forth can be applied alone or in combination with each other.

The photographic emulsion used in the present invention can be spectrally sensitized with photographic sensitizing dyes. Suitable sensitizing dyes include cyanine dyes, merocyanine dyes, complex cyanine dyes, complex merocyanine dyes, holopolar cyanine dyes, hemicyanine dyes, styryl dyes, and hemioxonol dyes.

These sensitizing dyes may be used alone or in combination. Combinations of sensitizing dyes are often employed, particularly for the purpose of supersensitization.

A dye which itself does not have a spectral sensitizing effect but exhibits a supersensitizing effect, or a substance which substantially does not absorb visible light but shows a supersensitizing effect may be incorporated in the emulsion together with the sensitizing dye. For example, aminostilbene compounds substituted with a nitrogen-containing heterocyclic group (for example, those described in U.S. Pat. Nos. 2,933,390 and 3,635,721), aromatic organic acid-formaldehyde condensates (for example, those described in U.S. Pat. No. 3,743,510), cadmium salts, azaindene compounds, etc., may be incorporated.

In the photographic emulsion used in the present invention, various compounds can be incorporated for the purpose of preventing the formation of fog during the production, storage, or processing of photographic light-sensitive materials, and of stabilizing the photographic properties of photographic light-sensitive materials.

Various color couplers can be employed in the present invention. Useful color couplers include cyan, magenta and yellow color forming couplers. Typical examples of these color couplers include naphthol or phenol type compounds, pyrazolone or pyrazoloazole type compounds and open chain or heterocyclic ketomethylene type compounds. Specific examples of utilizable cyan, magenta and yellow couplers in the present invention are described in the patents cited in *Research Disclosure*, RD No. 17643, VII-D (Dec., 1978) and ibid., RD No. 18717 (Nov., 1979).

It is preferable that color couplers which are incorporated into the photographic light-sensitive material are nondiffusible due to containing a ballast group or being polymerized. Further, 2-equivalent color couplers the coupling active position of which is substituted with a group capable of being released are preferred in comparison with 4-equivalent color couplers the coupling active position of which is substituted with a hydrogen atom since the coating amount of silver is reduced. Also, couplers which form colored dyes having an appropriate diffusibility, non-color-forming couplers, or couplers capable of releasing development inhibitors (DIR couplers) or couplers capable of releasing development accelerators (DAR couplers) as the course of the coupling reaction can be employed.

As typical yellow couplers used in the present invention, oil protected acylacetamide type couplers are exemplified. Specific examples thereof are described in U.S. Pat. Nos. 2,407,210, 2,875,057 and 3,265,506, etc. In the present invention, 2-equivalent yellow couplers are preferably employed and typical examples thereof include yellow couplers of oxygen atom releasing type as described in U.S. Pat. Nos. 3,408,194, 3,447,928, 3,933,501 and 4,022,620, etc., and yellow couplers of nitrogen atom releasing type described in Japanese Patent Publication No. 10739/83, U.S. Pat. Nos. 4,401,752 and 4,326,024, *Research Disclosure*, RD No. 18053 (Apr., 1979), British Patent 1,425,020, West German Patent Application (OLS) Nos. 2,219,917, 2,261,361, 2,329,587 and 2,433,812, etc. α-Pivaloylacetanilide type couplers are characterized by excellent fastness, particularly light fastness of dyes formed, and β-benzoylacetanilide type couplers are characterized by providing high color density.

As cyan couplers used in the present invention, oil protected naphthol type and phenol type couplers are exemplified. Typical examples thereof include naphthol type couplers described in U.S. Pat. No. 2,474,293 and preferably oxygen atom releasing type 2-equivalent naphthol type couplers described in U.S. Pat. Nos. 4,052,212, 4,146,396, 4,229,233 and 4,296,200, etc. Specific examples of phenol type couplers are described in U.S. Pat. Nos. 2,369,929, 2,801,171, 2,772,162, 2,895,826, etc.

Cyan couplers fast to humidity and temperature are preferably used in the present invention. Typical examples thereof include phenol type cyan couplers having an alkyl group having 2 or more carbon atoms at the meta-position of the phenol nucleus described in U.S. Pat. No. 3,772,002, 2,5-diacylamino-substituted phenol type couplers described in U.S. Pat. Nos. 2,772,162, 3,758,308, 4,126,396, 4,334,011 and 4,327,173, West German Patent Application (OLS) No. 3,329,729 and Japanese Patent Application No. 42671/83, etc., and phenol type couplers having a phenol ureido group at the 2-position thereof and an acylamino group at the 5-position thereof described in U.S. Pat. Nos. 3,446,622, 4,333,999, 4,451,559 and 4,427,767, etc.

Further, couplers which form dyes having appropriate diffusibility can be used together. Specific examples of such types of magenta couplers are described in U.S. Pat. No. 4,336,237 and British Pat. No. 2,125,570, etc., and those of yellow, magenta and cyan couplers are described in European Pat. No. 96,570 and West German Patent Application (OLS) No. 3,234,533, etc.

These dye forming couplers and special couplers described above may be used in the form of polymers including dimers or higher polymers except for couplers capable of forming diffusible dyes. Typical examples of dye forming polymer couplers are described in U.S. Pat. Nos. 3,451,820 and 4,080,211, etc. Specific examples of magenta polymer couplers are described in British Pat. No. 2,102,173, U.S. Pat. No. 4,367,282, etc.

Two or more kinds of various couplers used in the present invention can be incorporated together in the same layer for the purpose of satisfying the properties required to the photographic light-sensitive materials, or the same compound can be added to two or more different layers.

The couplers which can be used in the present invention can be incorporated into photographic light-sensitive materials using various known dispersing methods. Typical examples thereof include a solid dispersing method, an alkali dispersing method, preferably a latex dispersing method and more preferably an oil-in-water type dispersing method. By means of the oil-in-water type dispersing method, couplers are dissolved in either an organic solvent having a high boiling point of 175° C. or more, an auxiliary solvent having a low boiling point, or a mixture thereof and then the solution is finely dispersed in an aqueous medium such as water or an aqueous gelatin solution, etc., in the presence of a surface active agent. Specific examples of the organic solvents having a high boiling point are described in U.S. Pat. No. 2,322,027, etc.

A standard amount of color coupler to be used is in a range of from 0.001 mol to 1 mol per mol of a light-sensitive silver halide. It is preferred to use a range from 0.01 mol to 0.5 mol for a yellow coupler, a range from 0.003 mol to 0.3 mol for a magenta coupler and a range from 0.002 mol to 0.3 mol for a cyan coupler, per mol of a light-sensitive silver halide.

The photographic light-sensitive material according to the present invention may contain hydroquinone derivatives, aminophenol derivatives, amines, gallic acid derivatives, catechol derivatives, ascorbic acid derivatives, non-color-forming couplers, sulfonamidophenol derivatives, etc., as color fog preventing agents or color mixing preventing agents.

In the color photographic light-sensitive material used in the present invention, various known organic color anti-fading agents can be employed. Typical examples of known organic color anti-fading agents include hindered phenols, for example, hydroquinones, 6-hydroxycoumarones, 5-hydroxycoumarans, spirochromans, p-alkoxyphenols, bisphenols, etc., gallic acid derivatives, methylenedioxybenzenes, aminophenols, hindered amines, or ether or ester derivatives thereof derived from each of these compounds by silylation or alkylation of the phenolic hydroxy group thereof. Further, metal complexes represented by (bissalicylaldoxymate) nickel complexes and (bis-N,N-dialkyldithiocarbamate) nickel complexes may be employed as anti-fading agent.

For the purpose of preventing deterioration of yellow dye images due to heat, humidity and light, compounds having both a hindered amine moiety structure and a hindered phenol moiety structure in their molecules as described in U.S. Pat. No. 4,268,593, etc., provide a good result. Further, in order to prevent deterioration of magenta dye images, particularly deterioration due to light, spiroindanes as described in Japanese Patent Application (OPI) No. 159644/81, etc., and chromans substituted with a hydroquinone diether or monoether as described in Japanese Patent Application (OPI) No. 89835/80, etc., provide a preferred result.

The photographic light-sensitive materual used in the present invention may contain an ultraviolet ray absorbing agent in a hydrophilic colloid layer thereof.

The photographic light-sensitive material used in the present invention may contain a water-soluble dye as a filter dye or for various purposes such as prevention of irradiation or halation in a hydrophilic colloid layer thereof.

The photographic light-sensitive material used in the present invention may contain a brightening agent of the stilbene series, triazine series, oxazole series or coumarin series, etc., in a photographic emulsion layer or other hydrophilic colloid layers. Water-soluble brightening agents may be employed. Also, water-insoluble brightening agents may be used in the form of a dispersion.

As a binder or a protective colloid which can be used in the photographic emulsion layer or an interlayer of the photographic light-sensitive material according to the present invention, gelatin is advantageously used, but other hydrophilic colloids may also be employed.

As gelatin, not only lime-processed gelatin conventionally used, but also acid-processed gelatin and enzyme-processed gelatin as described in *Bull. Soc. Sci. Phot. Japan*, No. 16, page 30 (1966) may be used. Further, hydrolyzed product of gelatin or enzyme decomposed product of gelatin may also be used.

The photographic light-sensitive material according to the present invention may contain an inorganic or organic hardener in the photographic light-sensitive layer or other hydrophilic colloid layers thereof, including a backing layer.

Moreover, into the photographic light-sensitive material according to the present invention can be incorporated various kinds of stabilizers, stain preventing agents, developing agents or precursors thereof, development accelerating agents or precursor thereof, lubricants, mordants, matting agents, antistatic agents, plasticizers or other additives useful for photographic light-sensitive materials in addition to the above-described additives. Typical examples of these additives are described in *Research Disclosure*, No. 17643 (Dec., 1978) and ibid., No. 18716 (Nov., 1979).

The present invention is also applicable to a multilayer multicolor photographic material having at least two photographic emulsion layers having different spectral sensitivities on a support. A multilayer natural color photographic material generally possesses at least one red-sensitive silver halide emulsion layer, at least one green-sensitive silver halide emulsion layer and at least one blue-sensitive silver halide emulsion layer, respectively, on a support. The order of these light-sensitive layers can be varied and appropriately determined depending on demands. Further, each of the above-described emulsion layers may be composed of two or more emulsion layers having different sensitivities. Moreover, between two or more emulsion layers having the same spectral sensitivity, a light-insensitive layer may be present.

It is preferred in the photographic light-sensitive material according to the present invention that an auxiliary layer, for example, a protective layer, an interlayer, a filter layer, an antihalation layer, a backing layer, etc., is appropriately provided in addition to the silver halide emulsion layer.

The present invention is described in greater detail with reference to the following examples, but the present invention is not to be construed as being limited thereto.

EXAMPLE 1

On a paper support, both surfaces of which were laminated with polyethylene, were coated layers as shown in Table A below in order to prepare Multilayer Color Photographic Light-Sensitive Materials (A) to (E) for printing paper, wherein various magenta couplers were employed, respectively, as shown below. The coating solutions were prepared in the following manner.

Preparation of Coating Solution for First Layer:

19.1 g of Yellow Coupler (a) and 4.4 g of Color Image Stabilizer (b) were dissolved in a mixture of 27.2 ml of ethyl acetate and 7.9 m( of Solvent (c) and the resulting solution was dispersed by emulsification in 185 ml of a 10 wt% aqueous solution of gelatin containing 8 ml of a 10 wt% aqueous solution of sodium dodecylbenzenesulfonate. On the other hand, to a silver chlorobromide emulsion (having a silver bromide content of 80 mol% and containing 70 g of silver per kg of the emulsion) was added $7.0\times10^{-4}$ mol of a blue-sensitive sensitizing dye shown below per mol of the silver chlorobromide to prepare 90 g of a blue-sensitive emulsion. The above-described dispersion was mixed with 90 g of the blue-sensitive silver chlorobromide emulsion, with the concentration of the resulting mixture being controlled with gelatin, to form the composition shown in Table A below, i.e., the coating solution for the first layer.

Coating solutions for the second layer to the seventh layer were prepared in a similar manner as described for the coating solution for the first layer. 2,4-Dichloro-6-hydroxy-s-triazine sodium salt was used as a gelatin hardener in each layer.

The following spectral sensitizing dyes were employed in the emulsion layers, respectively.

Blue-Sensitive Emulsion Layer (First Layer):

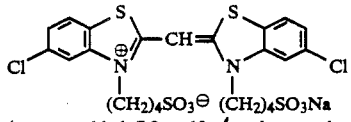

(amount added: $7.0\times10^{-4}$ mol per mol of silver halide)

Green-Sensitive Emulsion Layer (Third Layer):

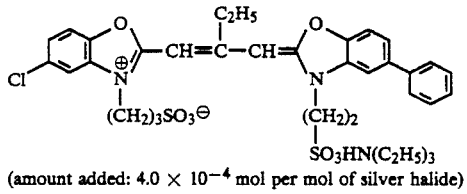

(amount added: $4.0\times10^{-4}$ mol per mol of silver halide)

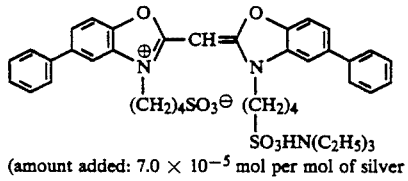

(amount added: $7.0\times10^{-5}$ mol per mol of silver halide)

Red-Sensitive Emulsion Layer (Fifth Layer):

-continued

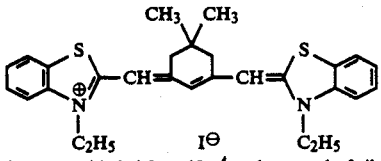

(amount added: $1.0 \times 10^{-4}$ mol per mol of silver halide)

The following dyes were employed as irradiation preventing dyes in the emulsion layers, respectively.

Green-Sensitive Emulsion Layer:

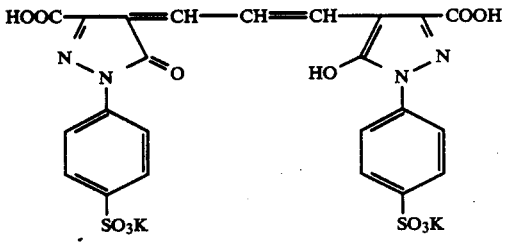

Red-Sensitive Emulsion Layer:

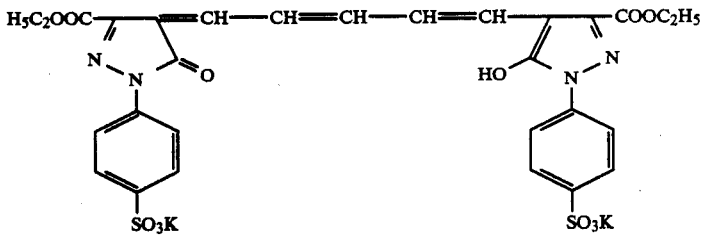

TABLE A

| | |
|---|---|
| Seventh Layer: Protective Layer | |
| Gelatin | 1.33 g/m$^2$ |
| Acryl-modified polyvinyl alcohol copolymer (degree of modification: 17%) | 0.17 g/m$^2$ |
| Sixth Layer: Ultraviolet Light-Absorbing Layer | |
| Gelatin | 0.54 g/m$^2$ |
| Ultraviolet Light Absorbing Agent (h) | 0.21 g/m$^2$ |
| Solvent (j) | 0.09 ml/m$^2$ |
| Fifth Layer: Red-Sensitive Layer | |
| Silver chlorobromide emulsion (silver bromide: 70 mol %) | 0.26 g/m$^2$ as Ag (silver content) |
| Gelatin | 0.98 g/m$^2$ |
| Cyan Coupler (k) | 0.38 g/m$^2$ |
| Color Image Stabilizer (l) | 0.17 g/m$^2$ |
| Solvent (m) | 0.23 ml/m$^2$ |
| Fourth Layer: Ultraviolet Light-Absorbing Layer | |
| Gelatin | 1.60 g/m$^2$ |
| Ultraviolet Light Absorbing Agent (h) | 0.62 g/m$^2$ |
| Color Mixing Preventing Agent (i) | 0.05 g/m$^2$ |
| Solvent (j) | 0.26 ml/m$^2$ |
| Third Layer: Green-Sensitive Layer | |
| Silver chlorobromide emulsion (silver bromide: 75 mol %) | 0.16 g/m$^2$ as Ag (silver content) |
| Gelatin | 1.80 g/m$^2$ |
| Magenta coupler (shown below) | 0.34 g/m$^2$ |
| Color Image Stabilizer (f) | 0.20 g/m$^2$ |
| Solvent (g) | 0.68 ml/m$^2$ |
| Second Layer: Color Mixing Preventing Layer | |
| Gelatin | 0.99 g/m$^2$ |
| Color Mixing Preventing Agent (d) | 0.08 g/m$^2$ |
| First Layer: Blue-Sensitive Layer | |
| Silver chlorobromide emulsion (silver bromide: 80 mol %) | 0.30 g/m$^2$ as Ag (silver content) |
| Gelatin | 1.86 g/m$^2$ |
| Yellow Coupler (a) | 0.82 g/m$^2$ |
| Color Image Stabilizer (b) | 0.19 g/m$^2$ |
| Solvent (c) | 0.34 ml/m$^2$ |

Support:

Polyethylene laminated paper (the polyethylene coating containing a white pigment ($TiO_2$) and a bluish dye (ultramarine) on the first layer side)

The compounds used in the above-described layers have the structures shown below, respectively.

Yellow Coupler (a):

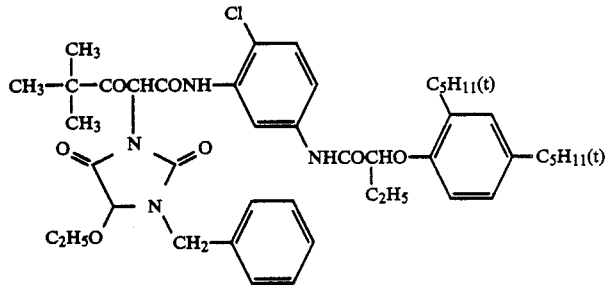

-continued
Color Image Stabilizer (b):
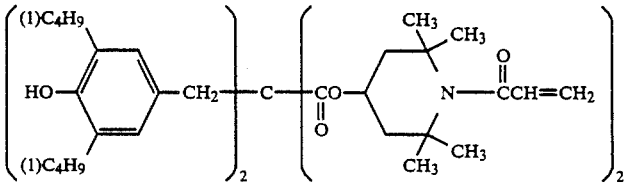
Solvent (c):
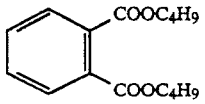
Color Mixing Preventing Agent (d):
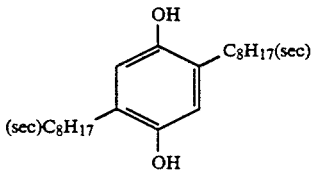
Color Image Stabilizer (f):
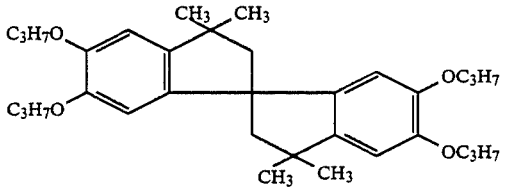
Solvent (g):
A mixture of $(C_8H_{17}O)_3P{=}O$ and 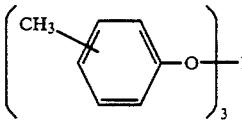 in a weight ratio of 2/1.
Ultraviolet Light-Absorbing Agent (h):
A mixture of 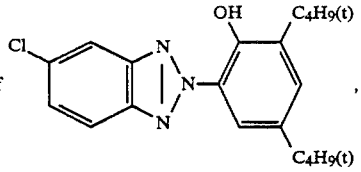 , 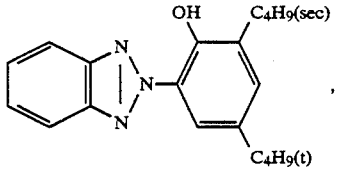 ,
and 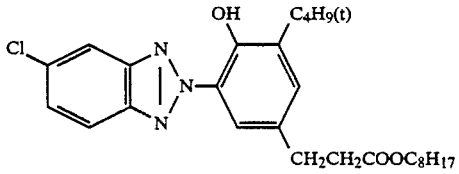 in a molar ratio of 1/5/3.
Color Mixing Preventing Agent (i):
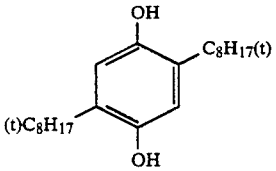
Solvent (j):
$(iso\text{-}C_9H_{18}O)_3P{=}O$
Cyan Coupler (k):

-continued
A mixture of
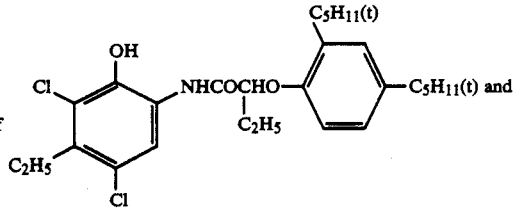
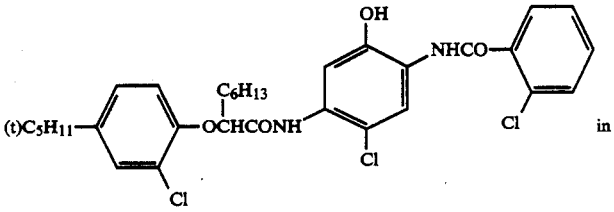
in a molar ratio of 1/1.
Color Image Stabilizer (l):
A mixture of
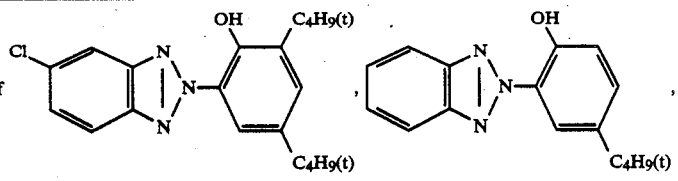
and
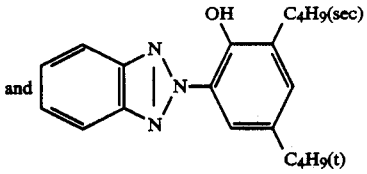
in a molar ratio of 1/3/3.
Solvent (m):
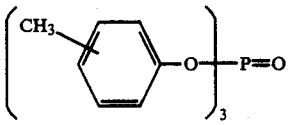
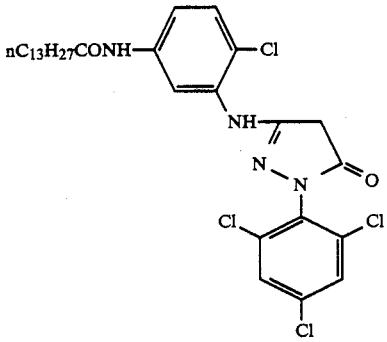
The magenta couplers employed in Samples (A) to (E) are as follows.
Sample (A):
(coating amount of silver in the third layer was changed to 0.35 g/m$^2$).
Sample (B):

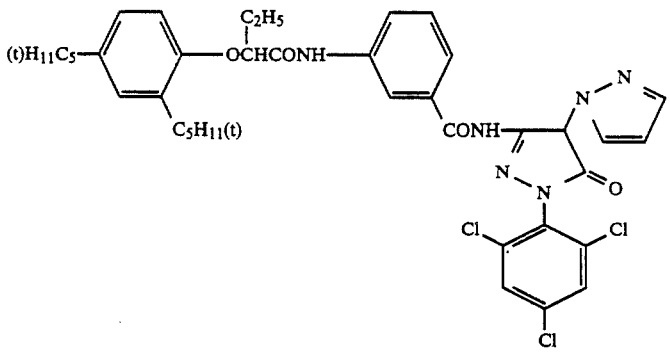

Sample (C):
(M-42) of the present invention.
Sample (D):
(M-43) of the present invention.
Sample (E):
(M-45) of the present invention.

Samples (A) to (E) thus prepared were subjected to stepwise exposure for sensitometry through each of blue, green and red filters using a sensitometer (FWH type manufactured by Fuji Photo Film Co., Ltd.; color temperature of light source: 3,200° K). The exposure was conducted at an exposure time of 0.5 second in an exposure amount of 250 CMS.

The exposed samples were then processed according to the following processing steps.

| Processing Step | Temperature (°C.) | Time |
|---|---|---|
| Color Development | 38 | 2 min 00 sec |
| Bleach-Fixing | 38 | 1 min 00 sec |
| Washing with Water | 24–33 | 1 min 00 sec |
| Drying | 80 | 50 sec |

The composition of each processing solution was as follows. With respect to color development, a color developing solution containing benzyl alcohol (Composition A) and a color developing solution which did not contain benzyl alcohol (Composition B) were employed.

| Color Developing Solution: | Composition A | Composition B |
|---|---|---|
| Diethylenetriaminepenta-acetic Acid | 2.0 g | 2.0 g |
| Benzyl Alcohol | 15 ml | — |
| Diethylene Glycol | 10 ml | — |
| $Na_2SO_3$ | 2.0 g | 2.0 g |
| KBr | 0.6 g | 0.6 g |
| Hydroxylamine Sulfate | 3.0 g | 3.0 g |
| 4-Amino-3-methyl-N-ethyl-N-[β-(methanesulfonamido)ethyl]-aniline Sulfate | 4.5 g | 4.5 g |
| $K_2CO_3$ | 30.0 g | 30.0 g |
| Water to make | 1,000 ml | 1,000 ml |
| pH | 10.25 | 10.25 |

| Bleach-Fixing Solution: | |
|---|---|
| Ammonium Thiosulfate (54% by weight aq. soln.) | 150 ml |
| $Na_2SO_3$ | 15 g |
| $NH_4[Fe(III)(EDTA)]$ | 55 g |
| EDTA.2Na | 4 g |
| Water to make | 1,000 ml |
| pH | 6.9 |

Samples (A) to (E) were processed using Developing Solution Compositions A to J, respectively, and with the magenta images thus obtained, the minimum densities (Dmin) and the maximum densities (Dmax) were measured using a Macbeth densitometer. The results obtained are shown in Table 1.

TABLE 1

| | Developing Solution | | | | Photographic Property | | | | | | | | | | |
|---|---|---|---|---|---|---|---|---|---|---|---|---|---|---|---|
| | | | | | Sample(A) | | Sample (B) | | Sample (C) | | Sample (D) | | Sample (E) | | |
| No. | Composition | Benzyl Alcohol | Compound Added | Amount (g/l) | Dmin | Dmax | Dmin | Dmax | Dmin | Dmax | Dmin | Dmax | Dmin | Dmax | Remark |
| 1 | A | Present | — | — | 0.18 | 2.35 | 0.22 | 2.40 | 0.20 | 2.45 | 0.20 | 2.45 | 0.20 | 2.40 | Comparison |
| 2 | B | Absent | — | — | 0.18 | 1.85 | 0.22 | 1.90 | 0.20 | 1.88 | 0.20 | 1.80 | 0.20 | 1.90 | Comparison |
| 3 | C | Present | (5) | 6.0 | 0.35 | 2.36 | 0.40 | 2.41 | 0.40 | 2.46 | 0.39 | 2.45 | 0.38 | 2.41 | Comparison |
| 4 | D | Present | (6) | 6.0 | 0.40 | 2.37 | 0.44 | 2.41 | 0.44 | 2.46 | 0.42 | 2.46 | 0.40 | 2.42 | Comparison |
| 5 | E | Present | (7) | 6.0 | 0.29 | 2.35 | 0.39 | 2.39 | 0.31 | 2.46 | 0.31 | 2.47 | 0.33 | 2.40 | Comparison |
| 6 | F | Present | (8) | 6.0 | 0.31 | 2.36 | 0.31 | 2.40 | 0.34 | 2.46 | 0.29 | 2.46 | 0.31 | 2.41 | Comparison |

TABLE 1-continued

| No. | Developing Solution: Composition | Benzyl Alcohol | Compound Added | Amount (g/l) | Photographic Property: Sample(A) Dmin | Sample(A) Dmax | Sample (B) Dmin | Sample (B) Dmax | Sample (C) Dmin | Sample (C) Dmax | Sample (D) Dmin | Sample (D) Dmax | Sample (E) Dmin | Sample (E) Dmax | Remark |
|---|---|---|---|---|---|---|---|---|---|---|---|---|---|---|---|
| 7 | G | Absent | (5) | 6.0 | 0.18 | 2.20 | 0.22 | 2.27 | 0.20 | 2.40 | 0.20 | 2.42 | 0.20 | 2.39 | Invention |
| 8 | H | Absent | (6) | 6.0 | 0.18 | 2.21 | 0.23 | 2.30 | 0.21 | 2.45 | 0.20 | 2.44 | 0.21 | 2.41 | Invention |
| 9 | I | Absent | (7) | 6.0 | 0.18 | 2.18 | 0.22 | 2.25 | 0.20 | 2.43 | 0.20 | 2.41 | 0.20 | 2.40 | Invention |
| 10 | J | Absent | (8) | 6.0 | 0.18 | 2.17 | 0.22 | 2.21 | 0.20 | 2.43 | 0.20 | 2.42 | 0.20 | 2.39 | Invention |

From the results shown in Table 1, it is apparent that when the compound according to the present invention is added to a color developing solution containing benzyl alcohol, severe magenta fog was formed (see Nos. 3 to 6). On the contrary, when the compound is added to a color developing solution without benzyl alcohol, sufficient color forming property was observed without the formation of fog (see Nos. 7 to 10). Particularly, in the case of using the magenta coupler represented by formula (II), further improved color forming property was achieved. Furthermore, almost the same results were obtained when the time of color development step was shortened to 1 minute.

EXAMPLE 2

The same procedure as described in Example 1 was repeated, except for changing the amount of the compound according to the present invention added to a developing solution to 9.0 g/l. Substantially the same results as shown in Example 1 were obtained.

EXAMPLE 3

On a paper support, both surfaces of which were laminated with polyethylene, were coated layers as shown in Table B below in order to prepare multilayer color photographic light-sensitive materials for printing paper. The coating solutions were prepared in the following manner.

Preparation of Coating Solution for First Layer 19.1 g of Yellow Coupler (a) and 4.4 g of Color Image Stabilizer (b) were dissolved in a mixture of 27.2 ml of ethyl acetate and 7.9 ml of Solvent (c) and the resulting solution was dispersed by emulsification in 185 ml of a 10 wt% aqueous solution of gelatin containing 8 ml of a 10 wt% aqueous solution of sodium dodecylbenzenesulfonate. On the other hand, to a silver chlorobromide emulsion (having a silver bromide content of 1.0 mol% and containing 70 g of silver per kg of the emulsion) was added $5.0\times10^{-4}$ mol of a blue-sensitive sensitizing dye shown below per mol of the silver chlorobromide to prepare 90 g of a blue-sensitive emulsion. The above-described dispersion was mixed with 90 g of the blue-sensitive silver chlorobromide emulsion, with the concentration of the resulting mixture being controlled with gelatin, to form the composition shown in Table B below, i.e., the coating solution for the first layer.

Coating solutions for the second layer to the seventh layer were prepared in a similar manner as described for the coating solution for the first layer. 2,4-Dichloro-6-hydroxy-s-triazine sodium salt was used as a gelatin hardener in each layer.

The following spectral sensitizing dyes were employed in the emulsion layers, respectively.

Blue-Sensitive Emulsion Layer:

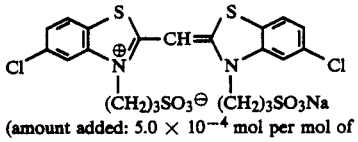

(amount added: $5.0\times10^{-4}$ mol per mol of silver halide)

Green-Sensitive Emulsion Layer:

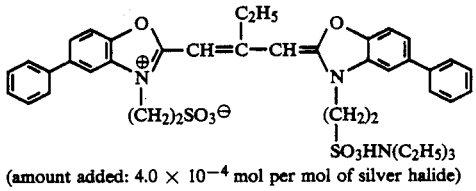

(amount added: $4.0\times10^{-4}$ mol per mol of silver halide)

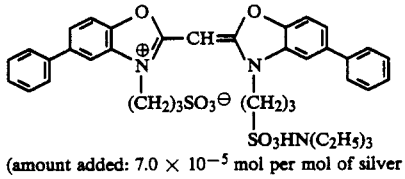

(amount added: $7.0\times10^{-5}$ mol per mol of silver halide)

Red-Sensitive Emulsion Layer:

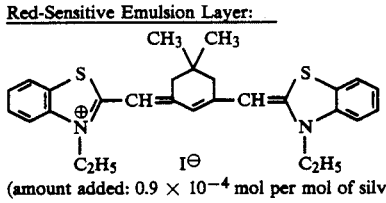

(amount added: $0.9\times10^{-4}$ mol per mol of silver halide)

The following dyes were employed as irradiation preventing dyes in the emulsion layers, respectively.

Green-Sensitive Emulsion Layer:

-continued

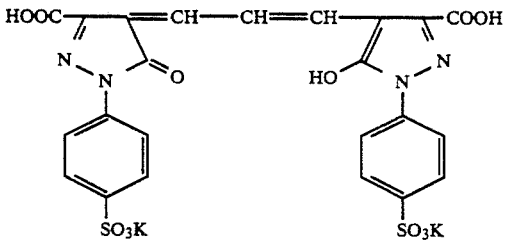

Red-Sensitive Emulsion Layer:

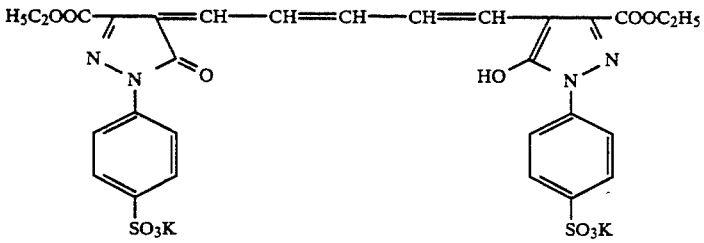

TABLE B

| | |
|---|---|
| Seventh Layer: Protective Layer | |
| Gelatin | 1.33 g/m$^2$ |
| Acryl-modified polyvinyl alcohol copolymer (degree of modification: 17%) | 0.17 g/m$^2$ |
| Sixth Layer: Ultraviolet Light-Absorbing Layer | |
| Gelatin | 0.54 g/m$^2$ |
| Ultraviolet Light-Absorbing Agent (h) | 0.21 g/m$^2$ |
| Solvent (j) | 0.09 ml/m$^2$ |
| Fifth Layer: Red-Sensitive Layer | |
| Silver chlorobromide emulsion (silver bromide: 1.0 mol %) | 0.26 g/m$^2$ as Ag (silver content) |
| Gelatin | 0.98 g/m$^2$ |
| Cyan Coupler (k) | 0.38 g/m$^2$ |
| Color Image Stabilizer (l) | 0.17 g/m$^2$ |
| Solvent (e) | 0.23 ml/m$^2$ |
| Fourth Layer: Ultraviolet Light-Absorbing Layer | |
| Gelatin | 1.60 g/m$^2$ |
| Ultraviolet Light-Absorbing Agent (h) | 0.62 g/m$^2$ |
| Color Mixing Preventing Agent (i) | 0.05 g/m$^2$ |
| Solvent (j) | 0.26 ml/m$^2$ |
| Third Layer: Green-Sensitive Layer | |

TABLE B-continued

| | |
|---|---|
| Silver chlorobromide emulsion (silver bromide: 0.5 mol %) | 0.16 g/m$^2$ as Ag (silver content) |
| Gelatin | 1.80 g/m$^2$ |
| Magenta Coupler (m) | 0.34 g/m$^2$ |
| Color Image Stabilizer (f) | 0.20 g/m$^2$ |
| Solvent (g) | 0.68 ml/m$^2$ |
| Second Layer: Color Mixing Preventing Layer | |
| Gelatin | 0.99 g/m$^2$ |
| Color Mixing Preventing Agent (d) | 0.08 g/m$^2$ |
| First Layer: Blue-Sensitive Layer | |
| Silver chlorobromide emulsion (silver bromide: 1.0 mol %) | 0.30 g/m$^2$ as Ag (silver content) |
| Gelatin | 1.86 g/m$^2$ |
| Yellow Coupler (a) | 0.82 g/m$^2$ |
| Color Image Stabilizer (b) | 0.19 g/m$^2$ |
| Solvent (c) | 0.34 ml/m$^2$ |

Support:

Polyethylene laminated paper (the polyethylene coating containing a white pigment ($TiO_2$) and a bluish dye (ultramarine) on the first layer side).

The compounds used in the above-described layers have the structures shown below, respectively.

Yellow Coupler (a):

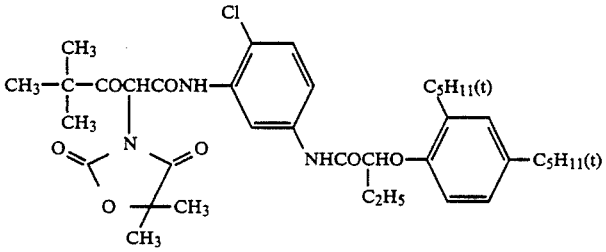

Color Image Stabilizer (b):

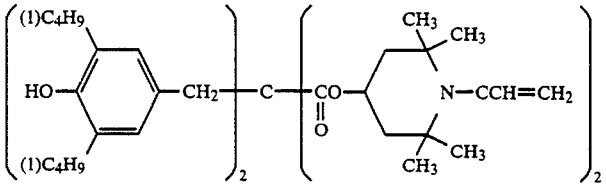

-continued
Solvent (c):
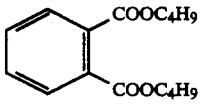
Color Mixing Preventing Agent (d):
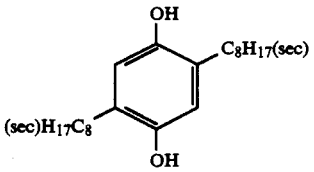
Solvent (e):
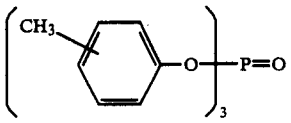
Color Image Stabilizer (f):
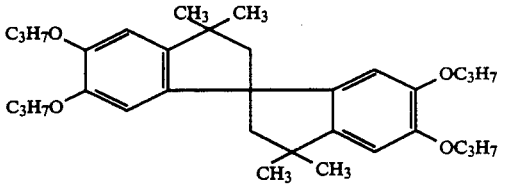
Solvent (g):
A mixture of $(C_8H_{17}O)_3P{=}O$ and 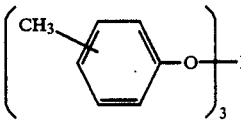 in a weight ratio of 2/1.
Ultraviolet Light-Absorbing Agent (h):
A mixture of 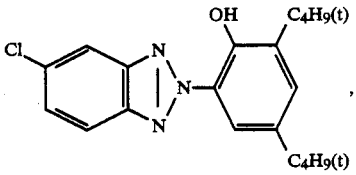
, 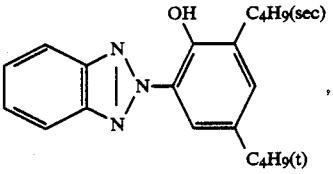
,
and 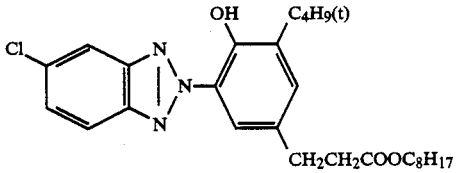
in a molar ratio of 1/5/3.
Color Mixing Preventing Agent (i):
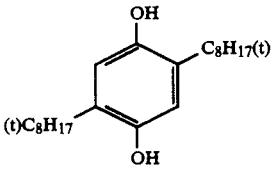
Solvent (j):
$(\text{iso-}C_9H_{18}O)_3P{=}O$
Cyan Coupler (k):

-continued

A mixture of

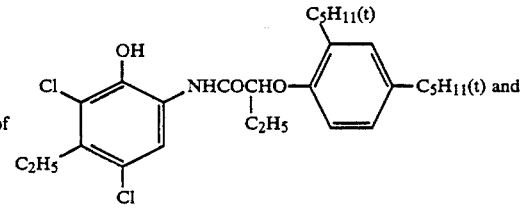

and

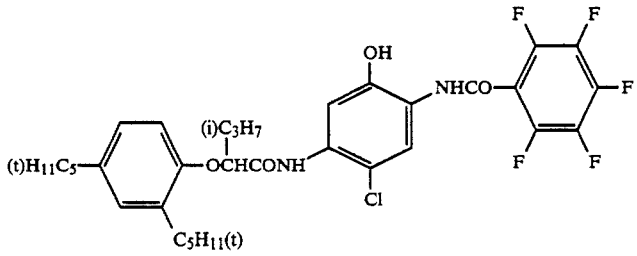

in a molar ratio of 1/1.

Color Image Stabilizer (l):

A mixture of

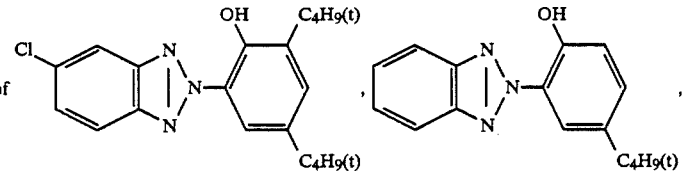

and

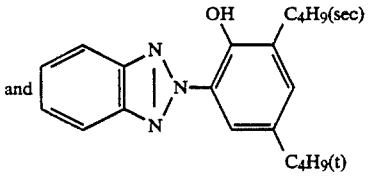

in a molar ratio of 1/3/3.

Magenta Coupler (m):

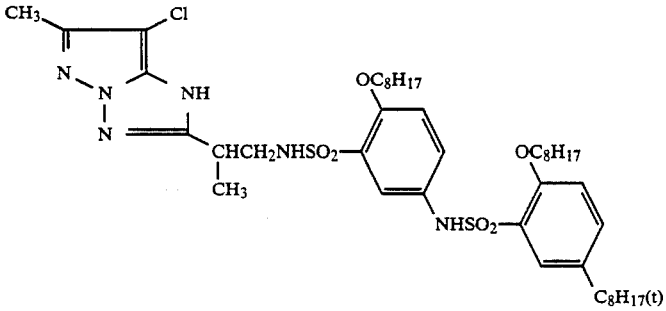

The color paper thus prepared was subjected to wedge exposure, and then development processed according to the following processing steps.

| Processing Step | Temperature (°C.) | Time |
|---|---|---|
| Color Development | 35 | Shown in Table 2 |
| Bleach-Fixing | 35 | 45 sec |
| Rinse 1 | 35 | 20 sec |
| Rinse 2 | 35 | 20 sec |
| Rinse 3 | 35 | 20 sec |
| Drying | 80 | 60 sec |

The composition of each processing solution was as follows.

| Color Developing Solution: | |
|---|---|
| Triethanolamine | 10 g |
| N,N-Diethylhydroxylamine | 4 g |

-continued

| Color Developing Solution: | |
|---|---|
| Sodium Sulfite | 0.2 g |
| Potassium Carbonate | 30 g |
| EDTA.2Na.2$H_2O$ | 2 g |
| Potassium Bromide | 0.01 g |
| 4-Amino-3-methyl-N-ethyl-N-[β-(methanesulfonamido)ethyl]aniline Sulfate | 5.0 g |
| Brightening Agent (4,4'-diaminostilbene type) | 3.0 g |
| Compound of the present invention | Shown in Table 2 |
| Water to make | 1,000 ml |
| pH | 10.20 |
| Bleach-Fixing Solution: | |
| EDTA Fe(III) $NH_4$.2$H_2O$ | 60 g |
| EDTA.2Na.2$H_2O$ | 4 g |
| Ammonium Thiosulfate (70 wt % aq. soln.) | 120 ml |
| Sodium Sulfite | 16 g |
| Glacial Acetic Acid | 7 g |
| Water to make | 1,000 ml |
| pH | 5.5 |

-continued

Color Developing Solution:

and then were processed using Developing Solution Compositions K to T described in Table 3.

The results obtained are shown in Table 3.

TABLE 3

| | Developing Solution | | | | Photographic Property | | | | | | | | | |
|---|---|---|---|---|---|---|---|---|---|---|---|---|---|---|
| | | Benzyl | | | Sample (A) | | Sample (B) | | Sample (C) | | Sample (D) | | Sample (E) | |
| No. | Composition | Alcohol | Compound Added | Amount (g/l) | Dmin | Dmax | Dmin | Dmax | Dmin | Dmax | Dmin | Dmax | Dmin | Dmax |
| 31 | K | Present | — | — | 0.18 | 2.35 | 0.22 | 2.40 | 0.20 | 2.45 | 0.20 | 2.45 | 0.20 | 2.40 |
| 32 | L | Absent | — | — | 0.18 | 1.85 | 0.22 | 1.90 | 0.20 | 1.88 | 0.20 | 1.80 | 0.20 | 1.90 |
| 33 | M | Present | (18) | 6.0 | 0.38 | 2.35 | 0.40 | 2.39 | 0.40 | 2.43 | 0.41 | 2.45 | 0.40 | 2.42 |
| 34 | N | Present | (34) | 6.0 | 0.35 | 2.30 | 0.40 | 2.40 | 0.39 | 2.41 | 0.38 | 2.43 | 0.39 | 2.43 |
| 35 | O | Present | (42) | 6.0 | 0.31 | 2.29 | 0.37 | 2.38 | 0.38 | 2.40 | 0.36 | 2.41 | 0.36 | 2.42 |
| 36 | P | Present | (43) | 6.0 | 0.37 | 2.31 | 0.40 | 2.40 | 0.41 | 2.43 | 0.41 | 2.42 | 0.40 | 2.44 |
| 37 | Q | Absent | (18) | 6.0 | 0.18 | 2.17 | 0.18 | 2.21 | 0.19 | 2.40 | 0.19 | 2.41 | 0.20 | 2.40 |
| 38 | R | Absent | (34) | 6.0 | 0.18 | 2.15 | 0.19 | 2.28 | 0.19 | 2.42 | 0.19 | 2.43 | 0.19 | 2.41 |
| 39 | S | Absent | (42) | 6.0 | 0.18 | 2.11 | 0.20 | 2.19 | 0.20 | 2.43 | 0.19 | 2.42 | 0.20 | 2.40 |
| 40 | T | Absent | (43) | 6.0 | 0.18 | 2.13 | 0.19 | 2.21 | 0.20 | 2.42 | 0.20 | 2.42 | 0.21 | 2.40 |

Rinse Solution:

| | |
|---|---|
| 1-Hydroxyethylidene-1,1'-diphosphonic Acid (60 wt % aq. soln.) | 1.6 ml |
| Bismuth Chloride | 0.35 g |
| Polyvinyl Pyrrolidone | 0.25 g |
| Aqueous Ammonia (26 wt % soln.) | 2.5 ml |
| Trisodium Nitrilotriacetate | 1.0 g |
| EDTA.4H | 0.5 g |
| Sodium Sulfite | 1.0 g |
| 5-Chloro-2-methyl-4-isothiazolin-3-one | 50 mg |
| Formalin (37 wt % soln.) | 0.1 ml |
| Water to make | 1,000 ml |
| pH | 7.0 |

The minimum densities (Dmin) and the maximum density (Dmax) of the color paper thus processed were measured using a Macbeth densitometer. The results obtained are shown in Table 2.

From the results shown in Table 3, it is apparent that when the compound according to the present invention is added to a color developing solution containing benzyl alcohol, severe magenta fog was formed (see Nos. 33 to 36). On the contrary, when the compound is added to a color developing solution without benzyl alcohol, sufficient color forming property was observed without the formation of fog (see Nos. 37 to 40). Particularly, in the case of using the magenta coupler represented by formula (III), further improved color forming property was achieved. Furthermore, almost the same results were obtained when the time of color development step was shortened to 1 minute.

EXAMPLE 5

The same procedure as described in Example 3 was repeated, except for changing the amount of the compound according to the present invention added to a developing solution to 9.0 g/l. Substantially the same results as shown in Example 3 were obtained.

TABLE 2

| | | Developing Solution | | | B | | G | | R | | |
|---|---|---|---|---|---|---|---|---|---|---|---|
| No. | Color Developing Time | Benzyl Alcohol (ml/l) | Compound of Formula (I) | Amount (g/l) | Dmin | Dmax | Dmin | Dmax | Dmin | Dmax | Remark |
| 11 | 3 min 30 sec | — | — | — | 0.25 | 1.90 | 0.29 | 2.13 | 0.24 | 2.23 | Comparison |
| 12 | 3 min 30 sec | 5 | — | — | 0.27 | 2.12 | 0.33 | 2.41 | 0.25 | 2.34 | Comparison |
| 13 | 3 min 30 sec | — | (6) | 10 | 0.25 | 2.10 | 0.31 | 2.40 | 0.26 | 2.35 | Comparison |
| 14 | 3 min | — | (6) | 10 | 0.23 | 2.10 | 0.27 | 2.40 | 0.24 | 2.35 | Comparison |
| 15 | 2 min 30 sec | — | (6) | 10 | 0.17 | 2.09 | 0.22 | 2.40 | 0.20 | 2.34 | Invention |
| 16 | 1 min 00 sec | — | (6) | 10 | 0.17 | 2.09 | 0.22 | 2.39 | 0.20 | 2.34 | Invention |
| 17 | 45 sec | — | (6) | 10 | 0.17 | 2.09 | 0.22 | 2.39 | 0.20 | 2.33 | Invention |
| 18 | 1 min 00 sec | 5 | — | — | 0.26 | 2.11 | 0.30 | 2.40 | 0.24 | 2.35 | Comparison |
| 19 | 30 sec | 5 | — | — | 0.25 | 2.10 | 0.28 | 2.40 | 0.23 | 2.35 | Comparison |
| 20 | 30 sec | 3 | — | — | 0.25 | 2.05 | 0.28 | 2.30 | 0.23 | 2.30 | Comparison |
| 21 | 1 min 00 sec | 3 | (6) | 10 | 0.24 | 2.10 | 0.27 | 2.40 | 0.23 | 2.35 | Comparison |
| 22 | 1 min 00 sec | — | — | — | 0.17 | 1.60 | 0.22 | 1.90 | 0.20 | 1.95 | Comparison |

As is apparent from the results shown in Table 2, sufficient color forming property was observed with low fog formation according to the method of the present invention (see Nos. 15 to 17). On the contrary, when benzyl alcohol is present in the color developing solution, fog increases (see Nos. 12 and 18 to 21). Further, the color forming property was decreased when the accelerator according to the present invention was not employed (see No. 22).

EXAMPLE 4

Samples (A) to (E) prepared in Example 1 were subjected to the same stepwise exposure as in Example 1,

EXAMPLE 6

The same samples as in Example 3 were subjected to wedge exposure, and then were processed using developing solution compositions described in Table 4 according to the same processing steps as in Example 3.

The results obtained are shown in Table 4.

TABLE 4

| No. | Color Developing Time | Developing Solution: Benzyl Alcohol (ml/l) | Developing Solution: Compound of the Present Invention | Developing Solution: Amount (g/l) | B Dmin | B Dmax | G Dmin | G Dmax | R Dmin | R Dmax | Remark |
|---|---|---|---|---|---|---|---|---|---|---|---|
| 41 | 3 min 30 sec | — | — | — | 0.25 | 1.90 | 0.29 | 2.13 | 0.24 | 2.23 | Comparison |
| 42 | 3 min 30 sec | 5 | — | — | 0.27 | 2.12 | 0.33 | 2.41 | 0.25 | 2.34 | Comparison |
| 43 | 3 min 30 sec | — | (34) | 10 | 0.26 | 2.11 | 0.30 | 2.39 | 0.24 | 2.35 | Comparison |
| 44 | 3 min | — | (34) | 10 | 0.24 | 2.11 | 0.28 | 2.39 | 0.23 | 2.34 | Comparison |
| 45 | 2 min 30 sec | — | (34) | 10 | 0.17 | 2.10 | 0.22 | 2.38 | 0.20 | 2.34 | Invention |
| 46 | 1 min 00 sec | — | (34) | 10 | 0.17 | 2.10 | 0.22 | 2.38 | 0.19 | 2.34 | Invention |
| 47 | 45 sec | — | (34) | 10 | 0.16 | 2.09 | 0.21 | 2.38 | 0.19 | 2.34 | Invention |
| 48 | 1 min 00 sec | 5 | — | — | 0.26 | 2.11 | 0.30 | 2.40 | 0.24 | 2.35 | Comparison |
| 49 | 30 sec | 5 | — | — | 0.25 | 2.10 | 0.28 | 2.40 | 0.23 | 2.35 | Comparison |
| 50 | 30 sec | 3 | — | — | 0.25 | 2.05 | 0.28 | 2.30 | 0.23 | 2.30 | Comparison |
| 51 | 1 min 00 sec | 3 | (34) | 10 | 0.25 | 2.10 | 0.29 | 2.39 | 0.24 | 2.35 | Comparison |
| 52 | 1 min 00 sec | — | — | — | 0.17 | 1.60 | 0.22 | 1.90 | 0.20 | 1.95 | Comparison |

As is apparent from the results shown in Table 4, sufficient color forming property was observed with low fog formation according to the method of the present invention (see Nos. 45 to 47). On the contrary, when benzyl alcohol is present in the color developing solution, fog increases (see Nos. 42 and 48 to 51). Further, the color forming property was decreased when the accelerator according to the present invention was not employed (see No. 52).

EXAMPLE 7

The same procedure as described in Example 6 was repeated, except that Compounds (3), (17), (42) and (49) were used instead of Compound (34) used in Table 4 of Example 6. As a result, the excellent photographic properties were obtained by containing the compound of the present invention.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material which comprises processing a silver halide color photographic material comprising a reflective support having thereon at least one silver halide emulsion layer containing silver chlorobromide having a silver bromide content of 20 mol % or less for a period of 2 minutes and 30 seconds or less with a color developing solution which contains 2 ml/liter or less of benzyl alcohol and does not contain a solvent for silver halide and which contains at least one compound selected from the group consisting of a compound represented by formula (I), a compound represented by formula (II), hydantoic acid, allylamine, aminoguanidine, o-aminobenzoic acid, L-(+)-cysteine, benzylamine, DL-serine, morpholine, N-hydroxyethyl morpholine, o-aminobenzyl alcohol, quinuclidine, or salts thereof, tetramethylammonium acetate, choline, or choline chloride

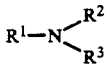

(I)

wherein $R^1$ represents a hydroxyalkyl group having from 2 to 10 carbon atoms; and $R^2$ and $R^3$ each represents a hydrogen atom, an alkyl group having from 1 to 10 carbon atoms, a hydroxylakyl group having from 2 to 20 carbon atoms, or a group represented by the formula

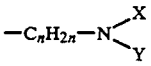

wherein n represents an integer from 1 to 10; and X and Y each represents a hydrogen atom, an alkyl group having from 1 to 10 carbon atoms, or a hydroxyalkyl group having from 2 to 10 carbon atoms,

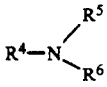

(II)

wherein $R^4$ represents an alkyl group having from 1 to 10 carbon atoms; $R^5$ and $R^6$ each represents a hydrogen atom or an alkyl group having from 1 to 10 carbon atoms.

2. A method for processing a silver halide color photographic material as in claim 1, wherein $R^1$ represents a hydroxyalkyl group having from 2 to 5 carbon atoms; one of $R^2$ and $R^3$ is a hydroxyalkyl group having 2 to 5 carbon atoms and the other is an alkyl group having from 2 to 5 carbon atoms.

3. A method for processing a silver halide color photographic material as in claim 1, wherein one of X and Y is a hydroxyalkyl group having from 2 to 5 carbon atoms and the other is an alkyl group having from 2 to 5 carbon atoms.

4. A method for processing a silver halide color photographic material as in claim 1, wherein the alkyl group represented by $R^2$, $R^3$, X or Y is an alkyl group substituted with a substituent selected from a chlorine atom, a carboxy group and an alkoxy group.

5. A method for processing a silver halide color photographic material as in claim 1, wherein $R^4$ represents an alkyl group having from 2 to 5 carbon atoms; $R^5$ and $R^6$ each represents a hydrogen atom or an alkyl group having from 1 to 5 carbon atoms.

6. A method for processing a silver halide color photographic material as in claim 1, wherein the amount of the compound present in the color developing solution is in a range of from 0.01 g to 20 g per liter of the color developing solution.

7. A method for processing a silver halide color photographic material as in claim 1, wherein the silver halide color photographic material contains a magenta coupler represented by formula (III)

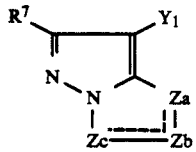

(III)

wherein $R^7$ represents a hydrogen atom or a substituent; $Y_1$ represents a group capable of being released upon a coupling reaction with an oxidation product of an aromatic primary amine developing agent; Za, Zb and Zc each represents an unsubstituted methine group, a substituted methine group, =N— or —NH—, one of the Za-Zb bond and the Zb-Zc bond being a double bond and the other being a single bond; when the Zb-Zc bond is a carbon-carbon double bond, the Zb=Zc bond forms a part of a condensed aromatic ring; or $R^7$ or $Y_1$ forms a dimer or higher polymer; or when Za, Zb or Zc is a substituted methine group, the substituted methine group forms a dimer or higher polymer.

8. A method for processing a silver halide color photographic material as in claim 7, wherein the magenta coupler is a bis coupler or a polymeric coupler containing a coupler moiety represented by formula (III).

9. A method for processing a silver halide color photographic material as in claim 7, wherein the magenta coupler is a homopolymer composed of a monomer having a coupler moiety represented by formula (III) or a copolymer composed of a monomer having a coupler moiety represented by formula (III) and a non-color-forming ethylenically unsaturated monomer which does not undergo coupling with the oxidation product of an aromatic primary amine developing agent.

10. A method for processing a silver halide color photographic material as in claim 7, wherein the magenta coupler is represented by a formula selected from the formulae (IV), (V), (VI), (VII), (VIII) and (IX)

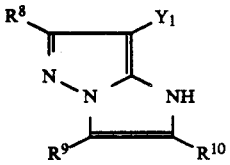

(IV)

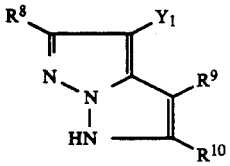

(V)

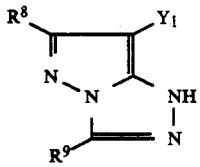

(VI)

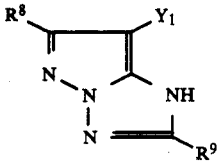

(VII)

-continued

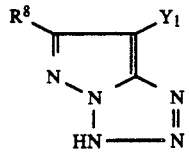

(VIII)

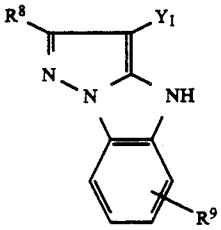

(IX)

wherein $R^8$, $R^9$ and $R^{10}$ each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and $Y_1$ represents a hydrogen atom, a halogen atom, a carboxyl group, or a coupling releasable group capable of being released upon coupling by being bonded with the carbon atom at the coupling position through an oxygen atom, a nitrogen atom or a sulfur atom; or $R^8$, $R^9$, $R^{10}$ or $Y_1$ represents a divalent group forming a bis coupler.

11. A method for processing a silver halide color photographic material as in claim 10, wherein the magenta coupler is a polymeric coupler in which the coupler moiety derived from the coupler represented by formula (IV), (V), (VI), (VII), (VIII) or (IX) is present in a vinyl monomer, and $R^8$, $R^9$ or $R^{10}$ represents a chemical bond or a connecting group, through which the coupler moiety is connected to the vinyl group.

12. A method for processing a silver halide color photographic material as in claim 10, wherein the divalent group to form a bis coupler represented by $R^8$, $R^9$, $R^{10}$ or $Y_1$ is a substituted or unsubstituted alkylene group, a substituted or unsubstituted phenylene group, or a group represented by the formula —NHCO—$R^{20}$— or —CONH—, wherein $R^{20}$ represents a substituted or unsubstituted alkylene group or a substituted or unsubstituted phenylene group.

13. A method for processing a silver halide color photographic material as in claim 11, wherein the connecting group represented by $R^8$, $R^9$ or $R^{10}$ is a substituted or unsubstituted alkylene group, a substituted or unsubstituted phenylene group, —NHCO—, —CONH—, —O—, —OCO—, an aralkylene group or a combination thereof.

14. A method for processing a silver halide color photographic material as in claim 11, wherein the vinyl group may further have a substituent selected from a chlorine atom and a lower alkyl group having from 1 to 4 carbon atoms in addition to the coupler moiety.

15. A method for processing a silver halide color photographic material as in claim 11, wherein the polymeric coupler is a copolymer containing a repeating unit derived from a non-color-forming ethylenically unsaturated monomer which does not couple with the oxidation product of an aromatic primary amine developing agent.

16. A method for processing a silver halide color photographic material as in claim 1, wherein the color developing solution does not contain benzyl alcohol.

17. A method for processing a silver halide color photographic material as in claim 1, wherein the period of color development is from 20 seconds to 2 minutes and 30 seconds.

18. A method for processing a silver halide color photographic material as in claim 1, wherein the period of color development is from 40 seconds to 2 minutes and 00 seconds.

19. A method for processing a silver halide color photographic material as in claim 1, wherein the color photographic material contains at least one compound represented by formula (I).

20. A method for processing a silver halide color photographic material as in claim 1, wherein the color photographic material contains at least one compound represented by formula (II).

21. A method for processing a silver halide color photographic material as in claim 1, wherein the color photographic material contains at least one compound selected from the group consisting of hydantoic acid, allylamine, aminoguanidine, o-aminobenzoic acid, L-(+)-cysteine, benzylamine, DL-serine, morpholine, N-hydroxyethyl morpholine, o-aminobenzyl alcohol, quinuclidine, or salts thereof, tetramethylammonium acetate, choline, or choline chloride.

* * * * *